US009701114B2

(12) United States Patent
Kojima

(10) Patent No.: US 9,701,114 B2
(45) Date of Patent: Jul. 11, 2017

(54) PRINTING APPARATUS

(71) Applicant: SEIKO EPSON CORPORATION, Tokyo (JP)

(72) Inventor: Kenji Kojima, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/924,996

(22) Filed: Oct. 28, 2015

(65) Prior Publication Data

US 2016/0136949 A1 May 19, 2016

(30) Foreign Application Priority Data

Nov. 13, 2014 (JP) ..... 2014-230436

(51) Int. Cl.
*B41J 2/045* (2006.01)
*B41J 25/308* (2006.01)
(Continued)

(52) U.S. Cl.
CPC ..... *B41J 2/04556* (2013.01); *B41J 2/04503* (2013.01); *B41J 2/04573* (2013.01); *B41J 2/2132* (2013.01); *B41J 3/28* (2013.01); *B41J 11/0035* (2013.01); *B41J 11/0095* (2013.01); *B41J 25/308* (2013.01); *B41J 29/393* (2013.01)

(58) Field of Classification Search
CPC ..... B41J 2/04556; B41J 2/04503; B41J 2/04573; B41J 2/2132; B41J 3/28; B41J 11/0035; B41J 11/0095; B41J 25/308; B41J 29/393
See application file for complete search history.

(56) References Cited

U.S. PATENT DOCUMENTS 7,559,616 B2 * 7/2009 Kuki ..... B41J 25/308 347/19
7,591,518 B2 * 9/2009 Murai ..... B41J 19/202 347/37
(Continued)

FOREIGN PATENT DOCUMENTS

JP 2006-239866 A 9/2006
JP 2010-105772 A 5/2010
JP 2014-094370 A 5/2014

OTHER PUBLICATIONS

The Extended European Search Report for the corresponding European Application No. 15194361.0 dated Apr. 21, 2016.

*Primary Examiner* — Thinh H Nguyen
(74) *Attorney, Agent, or Firm* — Global IP Counselors, LLP

(57) ABSTRACT

A printing apparatus includes a transport mechanism section which has a support surface that supports and transports a workpiece, a printing mechanism section which has an ink jet head that executes printing on the workpiece that is transported by the transport mechanism section, a detecting section which is provided further on the upstream side in the transport direction than the ink jet head and detects an upper surface position of the workpiece, an adjustment section which adjusts a separation distance between the support surface and the ink jet head, and a control section. In addition, the control section selects a first mode for printing and a second mode for stopping printing by adjusting the separation distance by operating the adjustment section based on a detection result of the detecting section.

13 Claims, 20 Drawing Sheets

(51) Int. Cl.

| | |
|---|---|
| ***B41J 2/21*** | (2006.01) |
| ***B41J 3/28*** | (2006.01) |
| ***B41J 11/00*** | (2006.01) |
| ***B41J 29/393*** | (2006.01) |

(56) References Cited

U.S. PATENT DOCUMENTS

| | | | | |
|---|---|---|---|---|
| 8,419,144 | B2 * | 4/2013 | Castillo | B41J 11/0035 347/16 |
| 2006/0192798 | A1 * | 8/2006 | Kuki | B41J 25/308 347/8 |
| 2012/0182341 | A1 | 7/2012 | Miura | |

* cited by examiner

FIRST TIME

SECOND TIME

THIRD TIME

FOURTH TIME

FIFTH TIME

SIXTH TIME
1A
6
611
61
Wx
Wxf
Wxb
Ws
131
133
100
W
R
531
53
Y
L1
L2

PRINTING APPARATUS

BACKGROUND

1. Technical Field

The present invention relates to a printing apparatus.

2. Related Art

A printing apparatus in the related art is used, which prints by applying ink on a recording medium (for example, refer to JP-A-2006-239866). The printing apparatus described in JP-A-2006-239866 is provided with transport means which transports the recording medium, an ink jet head which discharges ink on the transported recording medium, cloth thickness detection means which detects the height of a recording surface of the recording medium which is transported by the transport means, and movement means which changes the height of the ink jet head according to the height position of the recording surface of the cloth which is detected by the cloth thickness detection means.

Such a printing apparatus, for example, is configured such that a threshold for the height of the recording surface of the recording medium is set, and the height of the ink jet head is adjusted in a case where the height of the recording surface of the recording medium exceeds the threshold.

In a case where a raised portion (wrinkle, join, or the like) where the position of the recording surface is detected as being higher than the threshold by a detecting section, printing is temporarily stopped manually by an operator, and printing is restarted after transportation of the raised portion further to the downstream side than the ink jet head is confirmed. At this time, according to the extent of the raised portion, the ink jet head is manually raised by the operator, and reaches a position so as not to come into contact with the raised portion.

According to such a method, the operator is burdened since the work is relatively great for the operator to detect the raised portion. That is, in the printing apparatus of the related art, after a raised portion is detected, it is not possible to easily perform printing until printing is restarted.

SUMMARY

An advantage of some aspects of the invention is to provide a printing apparatus which is able to reduce the burden on an operator, and is able to favorably perform printing.

Such an advantage is achieved by the aspects of the invention below.

Application Example 1

According to this application example of the invention, there is provided a printing apparatus including a transport section which has a support surface that supports a recording medium with a sheet form, and supports and transports the recording medium on the support surface, a printing section which is disposed facing the support surface via a gap, and has a nozzle that executes printing on the recording medium which is transported by the transport section, a detecting section which is provided further on the upstream side in the transport direction of the recording medium than the nozzle, and detects an upper surface position of the recording medium, an adjustment section which adjusts a separation distance between the support surface and the nozzle, and a control section which controls the operation of the transport section, the printing section, the detecting section, and the adjustment section, in which the control section selects a first mode for printing and a second mode for stopping the printing by adjusting the separation distance by operating the adjustment section based on a detection result of the detecting section.

In this case, it is possible to reduce the burden on the operator, and it is possible to favorably perform printing.

Application Example 2

In the printing apparatus according to the application example of the invention, it is preferable that in a case where the detecting section detects a raised portion where the upper surface position is raised, the control section selects the first mode if the height of the raised portion is less than a predetermined threshold, and selects the second mode if the height of the raised portion is equal to the predetermined threshold or more than the predetermined threshold.

In this case, it is possible to accurately detect the raised portion.

Application Example 3

In the printing apparatus according to the application example of the invention, it is preferable that the adjustment section adjusts the height of the nozzle, and in the first mode, the separation distance is adjusted by raising the nozzle position according to the height of the raised portion when the raised portion passes below the nozzle.

In this case, it is possible to avoid the raised portion coming into contact with the nozzle.

Application Example 4

In the printing apparatus according to the application example of the invention, it is preferable that printing is performed by discharging ink from the nozzle, and in the first mode, the control section adjusts the timing at which the ink is discharged according to the extent of the separation distance.

In this case, it is possible to favorably perform printing regardless of the separation distance.

Application Example 5

In the printing apparatus according to the application example of the invention, it is preferable that in the second mode, the stopping of the printing is maintained until the raised portion is moved further to the downstream side in the transport direction of the recording medium than the nozzle.

In this case, it is possible to reduce ink wastage.

Application Example 6

In the printing apparatus according to the application example of the invention, it is preferable that in the second mode, in a case where the height of the raised portion is higher than the position of the nozzle when the printing is stopped, to increase the height of the nozzle above the upper surface position of the raised portion.

In this case, it is possible to avoid the raised portion coming into contact with the nozzle.

Application Example 7

In the printing apparatus according to the application example of the invention, it is preferable that in the second mode, when the printing is stopped, the transport section increases a transport speed at which the recording medium is transported to be greater than a transport speed of the recording medium during printing.

In this case, it is possible to perform printing with good efficiency.

Application Example 8

In the printing apparatus according to the application example of the invention, it is preferable that the transport section has a motor and an encoder which detects an amount of rotation of the motor, and the control section detects the timing at which the adjustment section is operated based on the amount of rotation of the motor that is detected by the encoder.

In this case, it is possible to accurately detect the timing at which the adjustment section is operated.

Application Example 9

In the printing apparatus according to the application example of the invention, it is preferable that the transport section transports the recording medium intermittently, and the control section detects the timing at which the adjustment section is operated based on the amount of transport of the recording medium in one time.

In this case, it is possible to accurately detect the timing at which the adjustment section is operated.

Application Example 10

In the printing apparatus according to the application example of the invention, it is preferable that the recording medium is belt-shaped and is transported in the longitudinal direction, and the detecting section has a light-receiving surface which receives light in the width direction of the recording medium.

In this case, it is possible to increase detection precision of the raised portion.

Application Example 11

According to this application example of the invention, there is provided a printing apparatus including a transport section which has a support surface that supports a recording medium with a sheet form, and supports and transports the recording medium on the support surface, a printing section which is disposed facing the support surface via a gap, and has a nozzle that executes printing by discharging ink on the recording medium which is transported by the transport section, a detecting section which is provided further on the upstream side in the transport direction of the recording medium than the nozzle, and detects an upper surface position of the recording medium, a notification section which notifies regarding a detection result of the detecting section, and a control section which controls the operation of the transport section, the printing section, the detecting section, and the notification section, in which the control section selects a first mode for continuing printing and a second mode for avoiding printing when operating the notification section.

In this case, it is possible to reduce the burden on the operator, and it is possible to favorably perform printing.

BRIEF DESCRIPTION OF THE DRAWINGS

The invention will be described with reference to the accompanying drawings, wherein like numbers reference like elements.

FIG. 29 is a diagram illustrating a touch panel which the printing apparatus that is illustrated in FIG. 28 is provided with.

DESCRIPTION OF EXEMPLARY EMBODIMENTS

Figure 1:
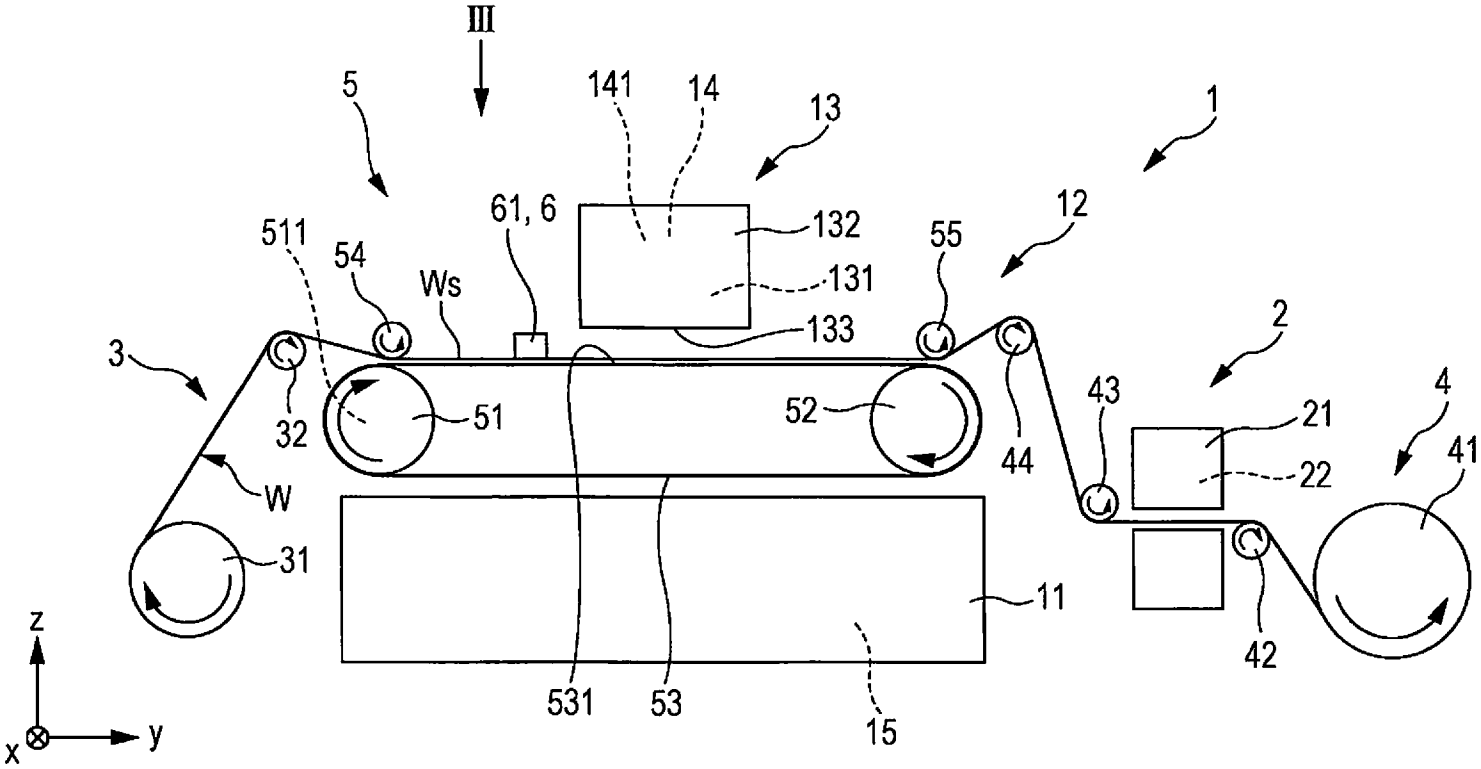
FIG. 1 is a side surface view schematically illustrating a first embodiment of a printing apparatus of the invention.

A printing apparatus of the invention will be described below in detail based on preferred embodiments which are illustrated in the drawings.

First Embodiment

Figure 2:
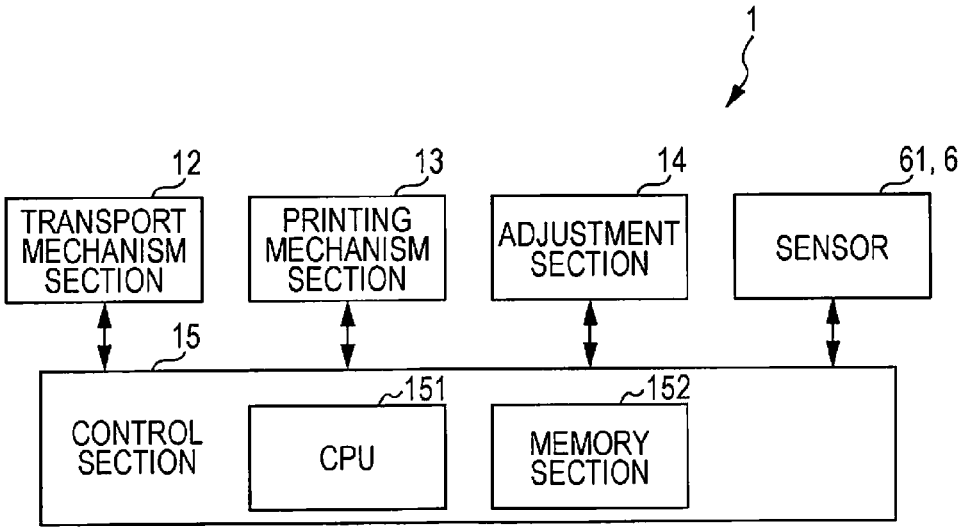
FIG. 2 is a block diagram of the printing apparatus which is illustrated in FIG. 1.
Figure 3:
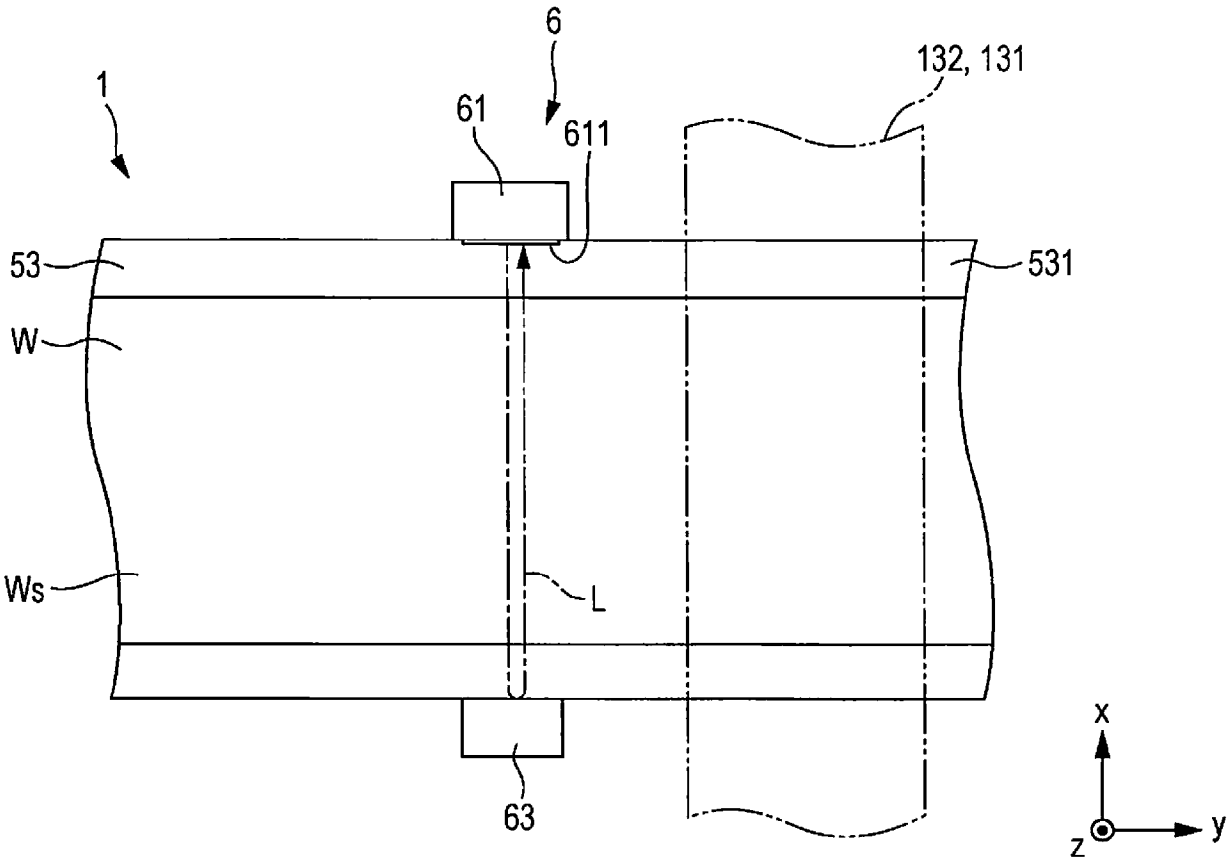
FIG. 3 is a diagram viewed from an arrow III direction in FIG. 1.
Figure 19:
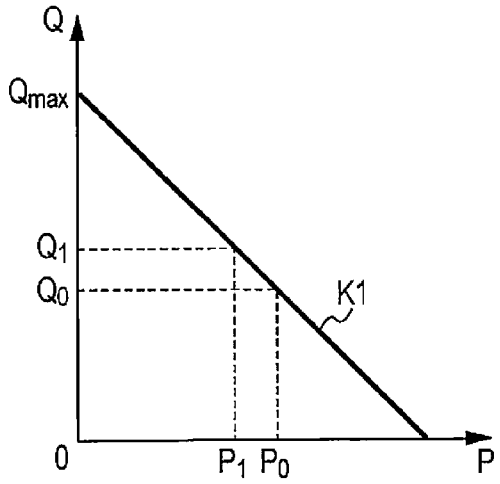
FIG. 19 is a graph illustrating a standard curve of the upper surface position and the amount of received light of the recording medium.
Figure 20:
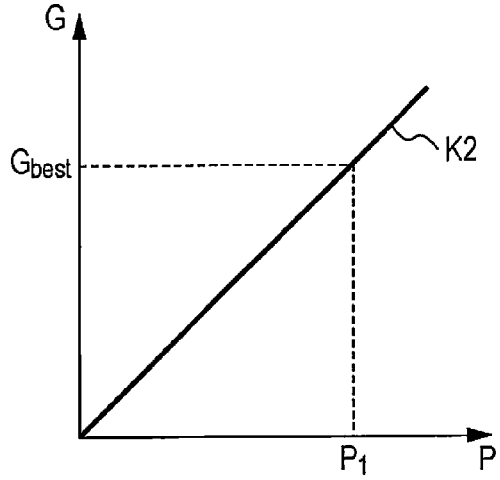
FIG. 20 is a graph illustrating a standard curve of the upper surface position and the separation distance of the recording medium.
Figure 21:
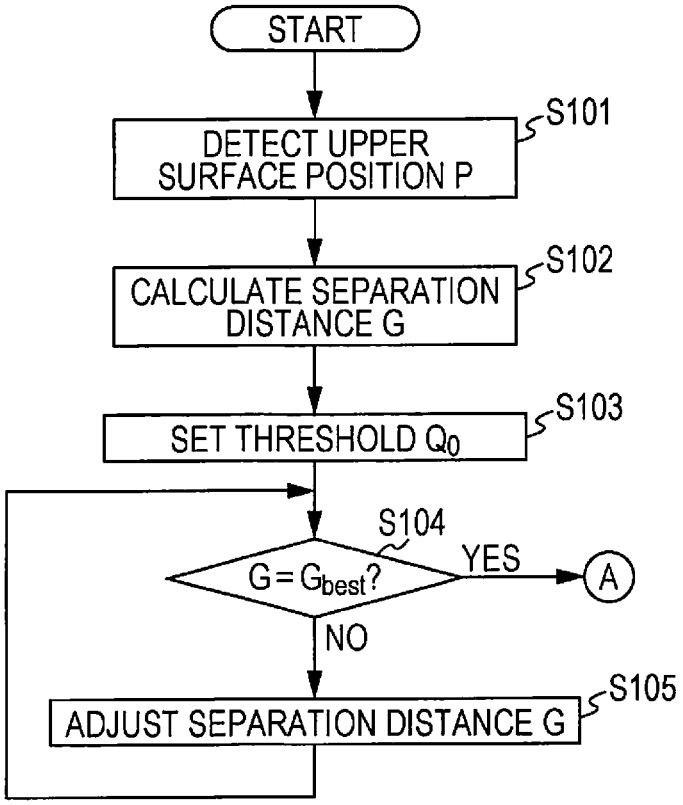
FIG. 21 is a flowchart illustrating a control program of the printing apparatus which is illustrated in FIG. 1.
Figure 22:
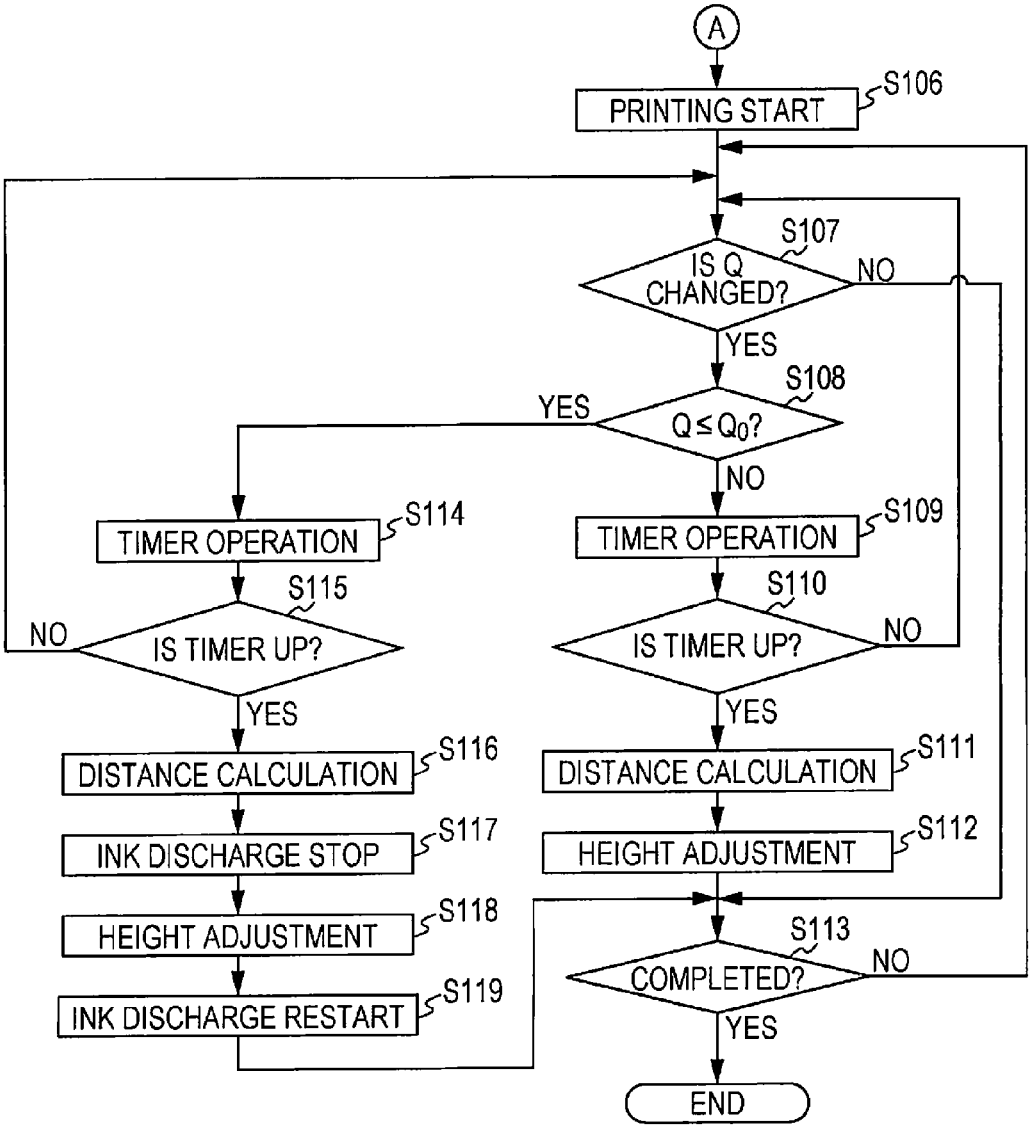
FIG. 22 is a flowchart illustrating a control program of the printing apparatus which is illustrated in FIG. 1.

FIG. 1 is a side surface view schematically illustrating a first embodiment of the printing apparatus of the invention. FIG. 2 is a block diagram of the printing apparatus which is illustrated in FIG. 1. FIG. 3 is a diagram viewed from an arrow III direction in FIG. 1. FIGS. 4 to 18 are diagrams for describing operations of the printing apparatus which is illustrated in FIG. 1. FIG. 19 is a graph illustrating a standard curve of the upper surface position and the amount of received light of the recording medium. FIG. 20 is a graph illustrating a standard curve of the upper surface position and the separation distance of the recording medium. FIG. 21 is a flowchart illustrating a control program of the printing apparatus which is illustrated in FIG. 1. FIG. 22 is a flowchart illustrating a control program of the printing apparatus which is illustrated in FIG. 1.

Here, for convenience of explanation, in FIG. 1 and FIG. 3 (in the same manner in FIG. 27), an x axis, a y axis, and a z axis are illustrated as three axes which are orthogonal to each other. The x axis is an axis along one direction (a width (depth) direction of the printing apparatus) in the horizontal direction, the y axis is an axis along a direction (a longitudinal direction of the printing apparatus) perpendicular to the x axis in the horizontal direction, and the z axis is an axis along a vertical direction (up and down direction). In addition, the leading end side of each arrow which is illustrated is set as a "positive side (+ side)" and the base end side is set as a "negative side (– side). In addition, in FIGS. 1, 3, and 4 to 18 (in the same manner in FIGS. 23A to 27, and FIGS. 30 to 32), the upper side is referred to as "upper (above)" and the lower side is referred to as "lower (below)".

As shown in FIGS. 1 and 2, a printing apparatus 1 is provided with a machine base 11, a transport mechanism section (transport section) 12 which transports a workpiece W as a recording medium, a printing mechanism section (recording section) 13 which executes printing by applying ink 100 on the workpiece W, a drying section 2 which dries the ink 100 on the workpiece W, and a detecting section 6.

In the present embodiment, a direction which is orthogonal to the transport direction in which the workpiece W is transported is an x axis direction, a direction which is parallel to the transport direction is a y axis direction, and a direction which is orthogonal to the x axis direction and the y axis direction is a z axis direction.

The transport mechanism section 12 is provided with a feeding device 3 which feeds the workpiece W with a long dimension that is wound in a roll shape, a winding device 4 which winds the printed workpiece W, and a support device 5 which is disposed on the machine base 11 and supports the workpiece W during printing.

The feeding device 3 is disposed further on the upstream side in a feeding direction (the y axis direction) of the workpiece W than the machine base 11. The feeding device 3 has a delivery roller (feeding reel) 31 which winds the workpiece W in a roll shape and delivers the workpiece W, and a tensioner 32 which applies tension to the workpiece W between the delivery roller 31 and the support device 5. The delivery roller 31 is connected to a motor (not shown in the drawings), and it is possible to rotate the delivery roller 31 by operating the motor.

Here, for the workpiece W, it is possible to use a thin film which has ink absorption, and a thin film which does not have ink absorption. In the case of the former, for example, dedicated paper for ink jet recording such as regular paper, fine quality paper, and glossy paper, and in addition, woven fabric and the like are given as examples. In the case of the latter, for example, a plastic film that is not surface treated (that is, an ink absorption layer is not formed) for ink jet printing and an article coated by a plastic on a base material such as paper, and an article to which a plastic film is adhered are given as examples. The plastic is not particularly limited, but for example, polyvinyl chloride, polyethylene terephthalate, polycarbonate, polystyrene, polyurethane, polyethylene, and polypropylene are given as examples.

The winding device 4 is disposed further on the downstream side in a feeding direction (the y axis direction) of the workpiece W than the machine base 11 with respect to the feeding device 3. The winding device 4 has a winding roller (winding reel) 41 which winds the workpiece W in a roll shape, and tensioners 42, 43, and 44 which apply tension to the workpiece W between the winding roller 41 and the support device 5. The winding roller 41 is connected to a motor (not shown in the drawings), and it is possible to rotate the winding roller 41 by operating the motor. The tensioners 42 to 44 are respectively disposed in a gap in order in a direction going away from the winding roller 41.

The support device 5 is disposed between the feeding device 3 and the winding device 4. The support device 5 has a main drive roller 51 and a driven roller 52 which are disposed separated from each other in the y axis direction, an endless belt 53 which is stretched over the main drive roller 51 and the driven roller 52 and supports the workpiece W on the surface (support surface), and tensioners 54 and 55 which apply tension to the workpiece W between the main drive roller 51 and the driven roller 52.

The main drive roller 51 is connected to a motor (not shown in the drawings), and it is possible to rotate the main drive roller 51 by operating the motor. In addition, rotational force of the main drive roller 51 is transmitted to the driven roller 52 via the endless belt 53, and it is possible for the driven roller 52 to rotate in conjunction with the main drive roller 51.

In addition, an encoder 511 is built in to the motor of the main drive roller 51. The encoder 511 is electrically connected to a control section 15, and an encoder value is transmitted to the control section 15.

The endless belt 53 is a belt on which an adhesive layer is formed, which has an adhesive on the front side surface. A portion of the workpiece W is fixed by adhesive to the adhesive layer, and is transported in the y axis direction. Then, printing is executed on the workpiece W during transport. In addition, after printing is executed, the workpiece W is peeled off from the endless belt 53.

In the same manner as the main drive roller 51 and the driven roller 52, the tensioners 54 and 55 are also disposed so as to be separated from each other in the y axis direction.

The tensioner 54 is able to interpose the workpiece W together with the endless belt 53 between the main drive roller 51 and the tensioner 54, and the tensioner 55 is able to interpose the workpiece W together with the endless belt 53 between the driven roller 52 and the tensioner 55. Thereby, the workpiece W to which tension is applied by the tensioners 54 and 55 is transported fixed to the endless belt 53 without change to the state in which the tension is applied. Due to such a state, during transport, the generation of wrinkles and the like on the workpiece W is reduced, and consequently, in a case where printing is executed, the printing is accurate and has high quality.

A printing mechanism section 13 is provided with a carriage unit 132 which has a plurality of ink jet heads 131 that perform recording by printing by discharging ink 100 on the workpiece W, and an x-axis table (not shown in the drawings) which supports the carriage unit 132 so as to be movable in the x axis direction. Each ink jet head 131 is, for example, provided with a head main body in which an internal head flow path that is filled with the ink 100 is formed, and a nozzle plate which has a nozzle surface to which multiple discharge nozzles are open. The head main body is configured by piezoelectric elements which respectively correspond to each discharge nozzle, and when voltage is applied to the piezoelectric element, the ink 100 is discharged from the discharge nozzle as liquid droplets.

In the printing apparatus 1, the workpiece W which is fed by the feeding device 3 is intermittently fed (sub-scanning) in the y axis direction in a state of being fixed by an adhesive to the endless belt 53, and with respect to the workpiece W in the fixed state, the ink 100 is discharged from the ink jet head 131 while the carriage unit 132 is reciprocated (main scanning) in the x axis direction. It is possible to perform printing until the printing is completed and an image pattern is formed on the workpiece W. Here, the image pattern may be formed by multi-color printing (color printing), and may be formed by single-color printing.

The ink 100 includes dye or pigment as a coloring agent in water as a solvent, and for example, has four colors of cyan (C), magenta (M), yellow (Y), and black (K). Then, the ink 100 of each color is discharged separately from the respective ink jet head 131.

An adjustment section 14 which is illustrated in FIGS. 1 and 2 is a raising/lowering mechanism which is able to adjust the height of the ink jet head 131. The adjustment section 14 is able, for example, to be configured having a motor, a ball screw, and a linear guide. In addition, an encoder 141 is built in the motor. It is possible to detect the height of the ink jet head 131 based on the amount of rotation which is detected by the encoder 141. Such an adjustment section 14 is also electrically connected to the control section 15.

As shown in FIG. 1, the drying section 2 is disposed further on the downstream side of the workpiece W in the transport direction than the printing mechanism section 13 between the support device 5 and the winding roller 41 of the winding device 4.

The drying device 2 has a chamber 21, and a coil 22 which is disposed inside the chamber 21. The coil 22 is, for example, configured by nichrome wire, and is a heating body which heats by power being supplied. Then, due to the heat which is emitted by the coil 22, it is possible to dry the ink 100 on the workpiece W inside the chamber 21 during transit.

As shown in FIGS. 1 to 18, the detecting section 6 is provided further on the upstream side of the workpiece W in the transport direction than the printing mechanism section 13 between the printing mechanism section 13 and the tensioner 54. The detecting section 6 detects an upper surface position P of the workpiece W which passes through. In addition, according to the detecting section 6, it is possible to detect a raised portion when the raised portion is generated where an upper surface Ws of the workpiece W is raised.

Here, the raised portion includes a wrinkle, curling, a join, and the like. When discharge of the ink 100 is performed on the raised portion, there is a concern that printing is not carried out normally on the raised portion, and that the raised portion collides with the ink jet head 131 according to the extent of the raised portion. In the present specification, as shown in FIGS. 12 to 15, cases where "wrinkle Wx" is given as an example of the "raised portion" are described below.

As shown in FIG. 3, the detecting section 6 has a sensor 61 and a reflecting section 63. The sensor 61 and the reflecting section 63 are disposed facing the endless belt 53 in the width direction.

The sensor 61 is disposed on one side (the upper side in FIG. 3) of the endless belt 53. The sensor 61 is a reflective photosensor which has a detection surface (light-receiving region) 611 which performs light emission and reception. The detection surface 611 has a square shape, and faces the −x axis direction. The length of each side of the detection surface 611 is not particularly limited, but is, for example, approximately 5 to 20 mm. On the detection surface 611, the detection region is from a side on the lower side to a side on the upper side.

In addition, the side on the lower side of the detection surface 611 overlaps with an upper surface 531 of the endless belt 53. That is, when viewed from the x axis direction, a gap is not formed between a first detection surface 611 and the endless belt 53. Thereby, the workpiece W on the endless belt 53 securely overlaps with the detection surface 611. Consequently, no matter how thin the workpiece W is, it is possible to detect wrinkles.

Such a sensor 61 is electrically connected to the control section 15, and controls an operation.

As shown in FIG. 3, the reflecting section 63 is disposed on the other side of the width direction (the lower side in FIG. 3) of the endless belt 53. The reflecting section 63 reflects light L from the sensor 61.

The light L which is emitted from the detection surface 611 is incident on the detection surface 611 by reflecting using the reflecting section 63. The printing apparatus 1 is configured such that a signal which includes information on the amount of received light Q on the detection surface 611 is transmitted to the control section 15. In addition, in the printing apparatus 1, it is possible to detect the upper surface position P based on the change of the amount of received light Q.

As shown in FIG. 2, the control section (determining section) 15 is electrically connected to the transport mechanism section 12, the printing mechanism section 13, the adjustment section 14, and the detecting section 6, and has the function for controlling the respective operations. In addition, the control section 15 has a central processing unit (CPU) 151 and a memory section 152.

The CPU 151 executes a program for various types of processes such as the printing process as described above.

The memory section 152, has, for example, an electrically erasable programmable read-only memory (EEPROM) which is a type of non-volatile semiconductor memory or the like, and is able to store various types of programs and the like.

Here, in the related art, in a case where the wrinkle Wx is detected, by the operator, for example, operating a touch panel, the printing apparatus performs operations such as the following.

First, discharge of the ink 100 is temporarily stopped. Then, the wrinkle Wx is transported to the downstream side of the ink jet head 131 without change to the state in which the transport mechanism section 12 operates. Printing is restarted if the wrinkle Wx is transported further to the downstream side than the ink jet head 131. At this time, if the wrinkle Wx and the ink jet head 131 appear to be about to collide, the ink jet head 131 is raised and reaches a position so as not to come into contact with the wrinkle Wx.

Since each of the operations are performed by touch panel operation by an operator, the operations are relatively complicated. For this reason, there is a possibility that an error occurs during touch panel operation, and in the invention, it is possible to prevent such errors. The operation of the printing apparatus 1 will be described below.

Figure 4:
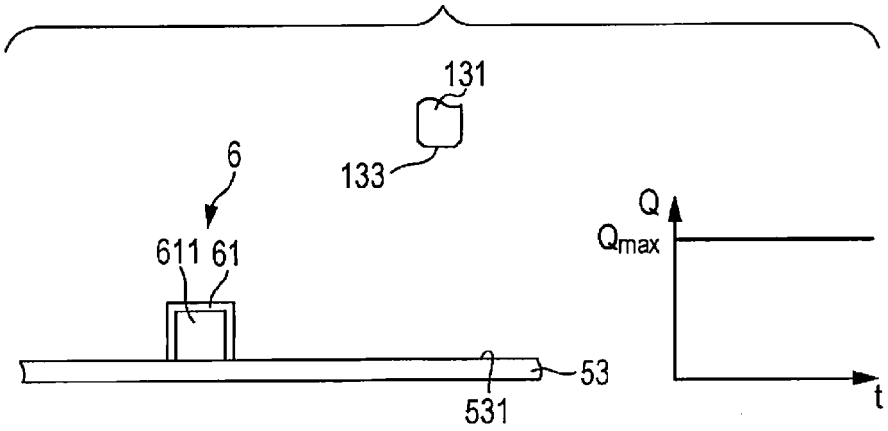
FIG. 4 is a diagram for describing an operation of the printing apparatus which is illustrated in FIG. 1.

First, the operator, for example, activates the printing apparatus 1 by operating the touch panel or the like. As shown in FIG. 4, in this state, the workpiece W is not yet disposed on the endless belt 53. In the state shown in FIG. 4, as shown by the hatching in FIG. 4, a portion which receives light in the detection surface 611 is the entire surface of the detection surface 611, and the amount of received light Q is the maximum amount of received light $Q_{max}$.

Figure 5:
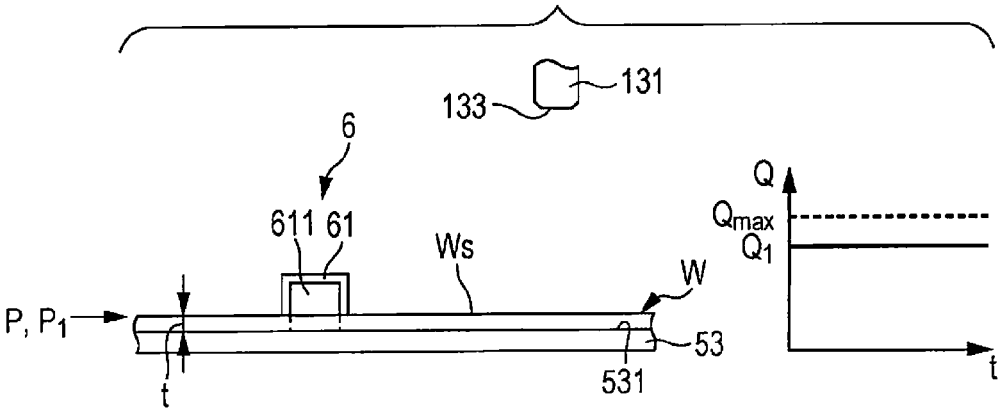
FIG. 5 is a diagram for describing an operation of the printing apparatus which is illustrated in FIG. 1.

Next, as shown in FIG. 5, the operator disposes that workpiece W on the upper surface 531 of the endless belt 53. At this time, the operator visually confirms that the workpiece W is straight. Here, "straight" has the meaning of a state in which there are no raised portions due to the wrinkle Wx or the like. In this state, the detection surface 611 is blocked by the workpiece W. For this reason, the portion which receives light in the detection surface 611 is eroded and becomes smaller than in the state shown in FIG. 4 (refer to the hatching in FIG. 5). Consequently, the amount of received light Q is an amount of received light $Q_1$ which is smaller than the amount of received light $Q_{max}$. As shown in FIG. 19, in the printing apparatus 1, it is possible to obtain the fact the upper surface position $P=P_1$ based on a standard curve K1 which illustrates a relationship between the amount of received light Q and the upper surface position P. The standard curve K1 is stored in advance in the memory section 152 as an arithmetic expression or a table (a standard curve K2 which will be described later is the same).

Here, in the state in which the workpiece W is straight as shown in FIG. 5, the upper surface position P becomes equivalent to a thickness t of the of workpiece W.

Figure 6:
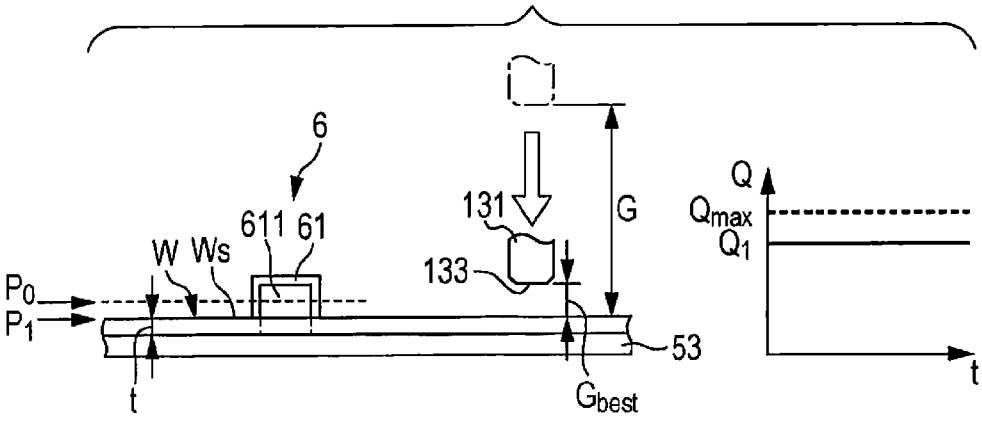
FIG. 6 is a diagram for describing an operation of the printing apparatus which is illustrated in FIG. 1.

Next, as shown in FIG. 6, a separation distance (distance of the gap) G of the upper surface Ws of the workpiece W from a lower surface 133 of the ink jet head 131 is adjusted using the adjustment section 14 and the separation distance $G_{best}$ is set. The separation distance $G_{best}$ is a separation distance at which it is possible to perform printing sharply. Thereby, it is possible to start printing at the securely optimal separation distance $G_{best}$.

Here, the adjustment of the separation distance G may be performed while directly measuring using a separate measuring instrument. The printing apparatus 1 has a scale in which a distance PG between the lower surface 133 of the ink jet head 131 and the endless belt 53 is displayed. Thereby, it is possible to adjust without using a separate measuring instrument such that from the displayed distance PG and the thickness t of the confirmed workpiece W, PG−t is $G_{best}$.

As shown in FIG. 20, in the printing apparatus 1, the separation distance $G_{best}$ is determined based on the standard curve K2 which illustrates the relationship between the upper surface position P of the workpiece W and the separation distance $G_{best}$, but it is possible to appropriately determine the separation distance $G_{best}$ according to the surface state of the workpiece W or the like.

In addition, in the printing apparatus 1, a reference position $P_0$ is set (refer to the graph in FIG. 6). The reference position $P_0$ is a determination criteria for whether the wrinkle Wx is generated if the upper surface position P of the workpiece W is raised to an extent. The reference position $P_0$ is set based on the upper surface position $P_1$ of the workpiece W obtained above and the separation distance $G_{best}$. In addition, the reference position $P_0$ is set to a height between the upper surface Ws of the workpiece W and the ink jet head 131. Then, when the reference position $P_0$ is set, a threshold $Q_0$ is set based on the standard curve K1.

Figure 7:
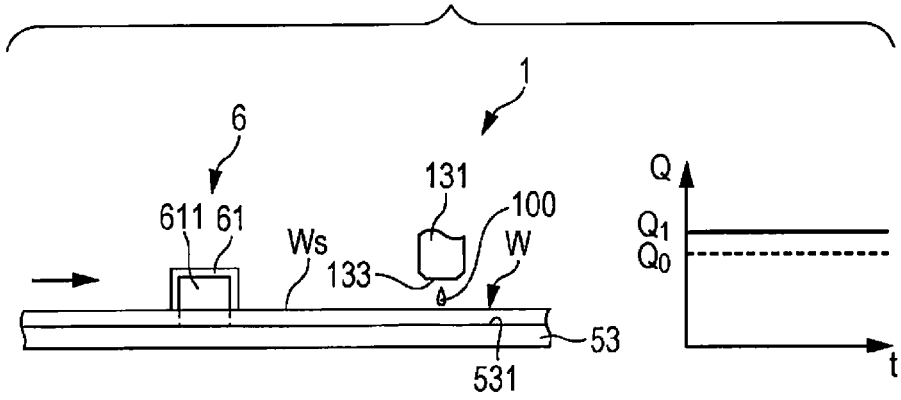
FIG. 7 is a diagram for describing an operation of the printing apparatus which is illustrated in FIG. 1.

As shown in FIG. 7, printing is started when the threshold $Q_0$ is set as above.

FIG. 7 is a diagram illustrating a state in which printing is performed in the printing apparatus 1. In this state, no wrinkle Wx is generated yet on the workpiece W which is transported in a state of being straight on the endless belt 53. In addition, the ink jet head 131 discharges the ink 100.

At this time, the detection surface 611 receives light at a portion shown by hatching in FIG. 7, and the amount of received light $Q=Q_1$ without change.

Figure 8:
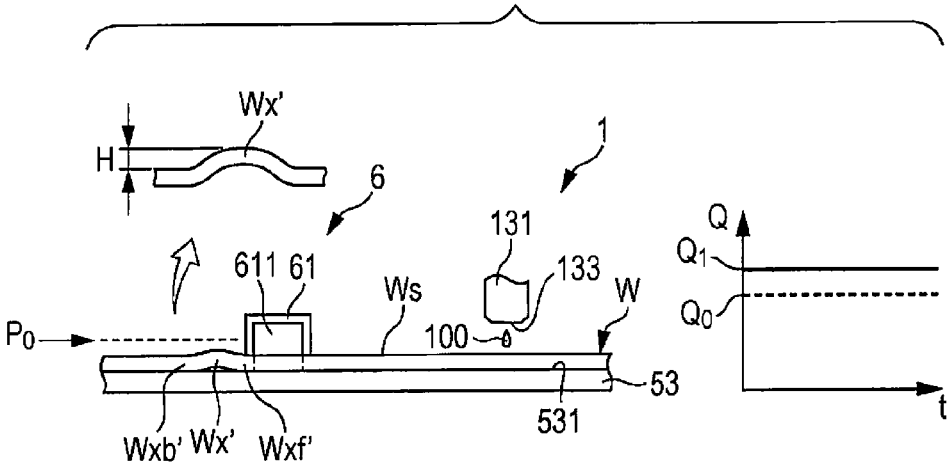
FIG. 8 is a diagram for describing an operation of the printing apparatus which is illustrated in FIG. 1.

As shown in FIG. 8, in a case where a wrinkle Wx' is generated further on the upstream side in the transport direction than the sensor 61, the wrinkle Wx' moves to the downstream side. The upper surface position P of the wrinkle Wx' is positioned at a lower position than the reference position $P_0$.

Figure 9:
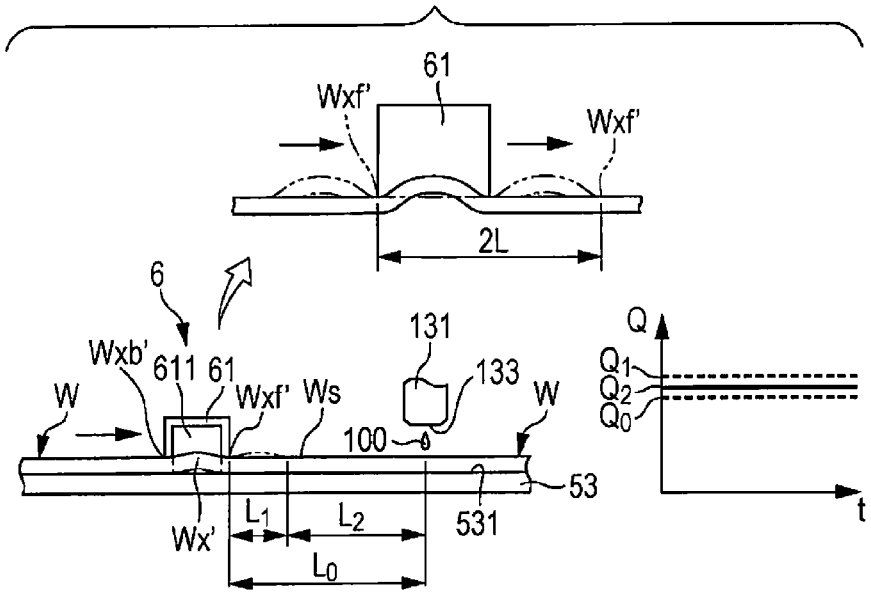
FIG. 9 is a diagram for describing an operation of the printing apparatus which is illustrated in FIG. 1.

Then, as shown in FIG. 9, the wrinkle Wx' moves to a position which overlaps with the detection surface 611. At this time, the amount of received light Q is reduced to less than the amount of received light $Q_1$ by the extent of the erosion due to the wrinkle Wx', but becomes an amount of received light $Q_2$ which is higher than the threshold $Q_0$. Since the amount of received light $Q_2$ is not less than the threshold $Q_0$, there is not a problem of executing printing on the wrinkle Wx'.

Figure 10:
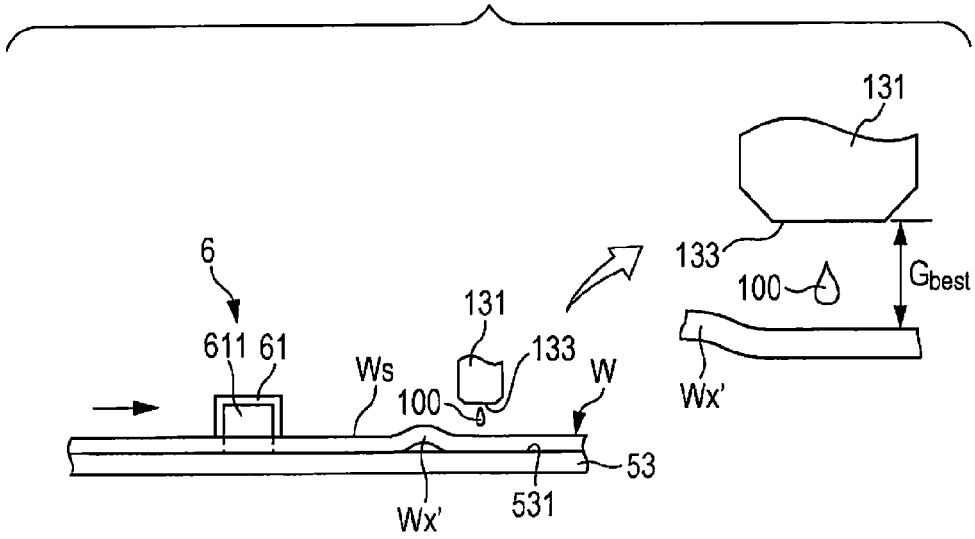
FIG. 10 is a diagram for describing an operation of the printing apparatus which is illustrated in FIG. 1.
Figure 11:
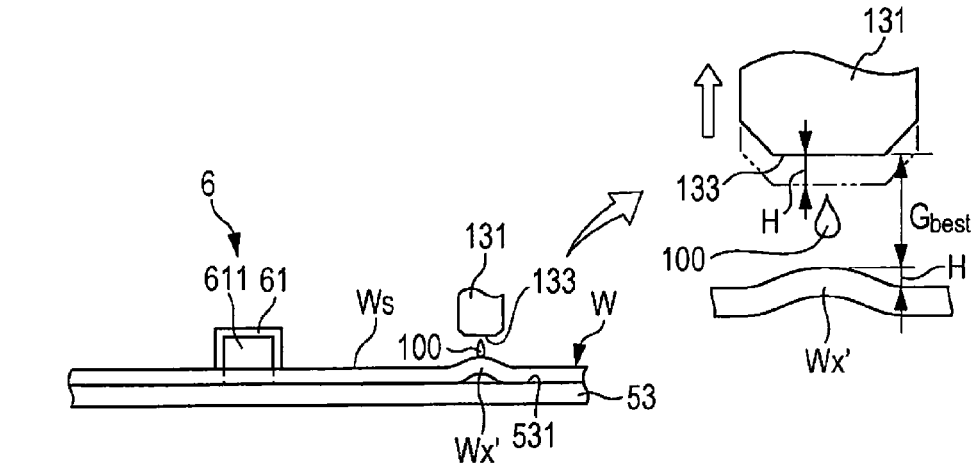
FIG. 11 is a diagram for describing an operation of the printing apparatus which is illustrated in FIG. 1.

As shown in FIG. 10, the wrinkle Wx' is transported further on the downstream side, and ultimately, as shown in FIG. 11, passes directly below the ink jet head 131. At this time, the adjustment section 14 is operated, and the ink jet head 131 is raised by a raised portion height H of the wrinkle Wx'. In addition, while rising, the ink jet head 131 discharges ink 100 with no change. For this reason, it is possible to perform printing even in the wrinkle Wx'.

Figure 12:
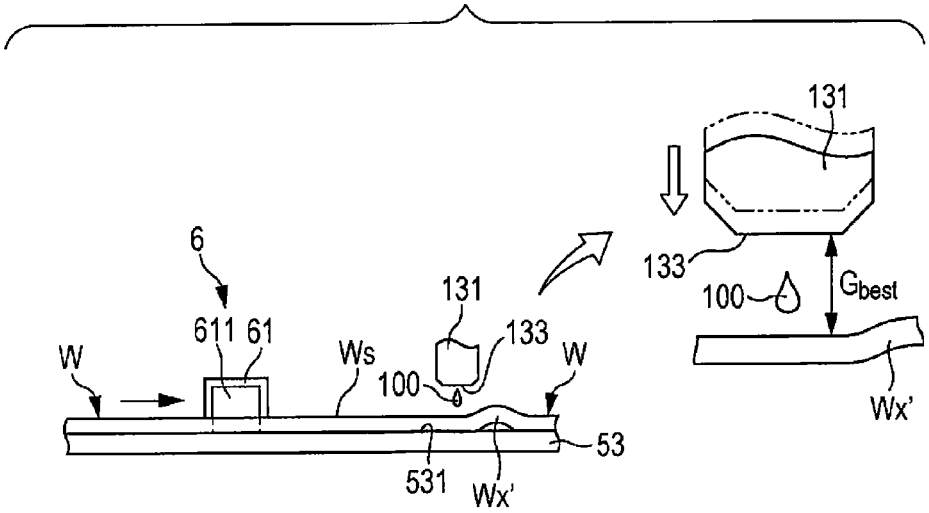
FIG. 12 is a diagram for describing an operation of the printing apparatus which is illustrated in FIG. 1.

Then, as shown in FIG. 12, if the wrinkle Wx is transported further on the downstream side than the ink jet head 131, the ink jet head 131 is lowered to return to the height illustrated in FIG. 10, and the separation distance $G=G_{best}$.

Due to such an operation, it is possible to maintain the separation distance $G=G_{best}$ even if the ink jet head 131 is raised or lowered. Thereby, it is possible to favorably perform printing even in the wrinkle Wx'.

It is preferable to accurately know the timing for raising and lowering the ink jet head 131 as above. In the printing apparatus 1, it is possible to accurately set the timing for raising and lowering using the method below.

In the printing apparatus 1, as illustrated by the chain double-dashed line in the enlarged diagram of FIG. 9, a numerical value of a distance 2L is obtained from a value of an encoder when a front end Wxf' of the wrinkle Wx' reaches the detection surface 611, and a value of an encoder up to the point where a back end Wxb' of the wrinkle Wx' comes away from the detection surface 611. The distance 2L is a length which is equivalent to two times a length $L_1$ in the transport direction of the wrinkle Wx'. For this reason, a numerical value of ½ of the obtained distance 2L is the length $L_1$ of the wrinkle Wx' (the same for the wrinkle Wx' described later).

In addition, the distance $L_0$ from the sensor 61 to the ink jet head 131 is the previous value. A value where the length $L_1$ of the wrinkle Wx' is subtracted from the distance $L_0$ ($L_0-L_1$) is the distance $L_2$ of the ink jet head 131 from the front end Wxf' of the wrinkle Wx'.

Since it is possible to obtain the distance $L_2$ as above, it is possible to accurately understand a distance by which the wrinkle Wx' is moved for the ink jet head 131 to be raised. That is, it is possible to accurately know the timing at which the ink jet head 131 is raised.

In addition, since the length $L_1$ of the wrinkle Wx' is understood, from the state in which the ink jet head 131 is raised as shown in FIG. 11, it is possible to accurately understand a distance by which the wrinkle Wx' is moved for the ink jet head 131 to be lowered. That is, it is possible to accurately know the timing at which the ink jet head 131 is lowered.

Next, as shown in FIGS. 13 to 18, a case will be described in which the wrinkle Wx is generated that is larger than the wrinkle Wx'.

Figure 13:
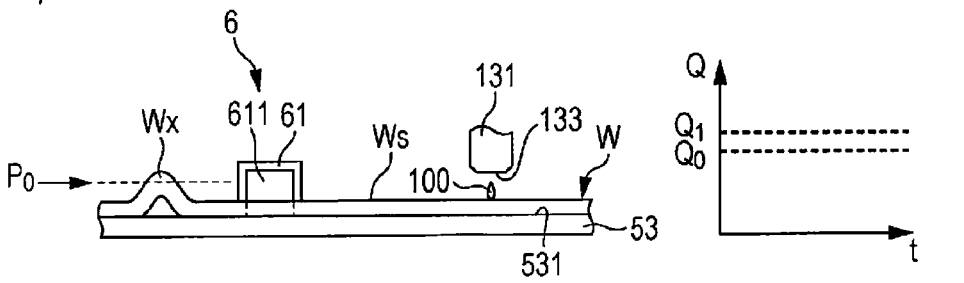
FIG. 13 is a diagram for describing an operation of the printing apparatus which is illustrated in FIG. 1.
Figure 14:
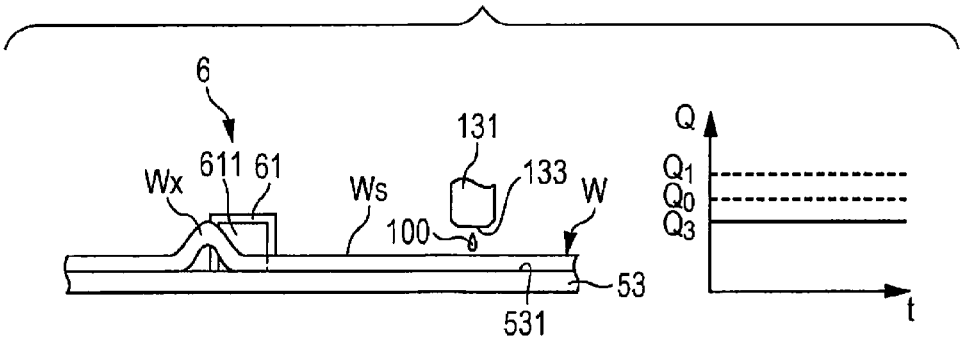
FIG. 14 is a diagram for describing an operation of the printing apparatus which is illustrated in FIG. 1.

FIG. 13 is a diagram illustrating a state in which the wrinkle Wx is transported from the upstream side further than the sensor 61. The upper surface position P of the wrinkle Wx is positioned at a higher position than the reference position $P_0$. As shown in FIG. 14, the wrinkle Wx is further moved to the downstream side and overlaps with the detection surface 611. At this time, the detection surface 611 is blocked by the wrinkle Wx. For this reason, a portion which receives light in the detection surface 611 is eroded, and the amount of received light Q becomes an amount of received light $Q_3$ which is lower than the threshold $Q_0$.

Figure 15:
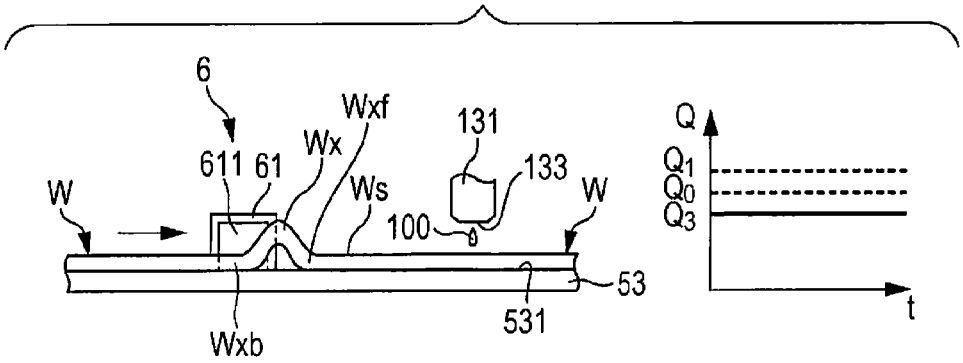
FIG. 15 is a diagram for describing an operation of the printing apparatus which is illustrated in FIG. 1.

Then, as shown in FIG. 15, the wrinkle Wx is moved further to the downstream side in a state in which the portion which receives light from the detection surface 611 is eroded. For this reason, a state in which the amount of received light $Q=Q_3$ is continued. When this continuation is detected, the wrinkle Wx is transported to the position of the sensor 61.

Figure 16:
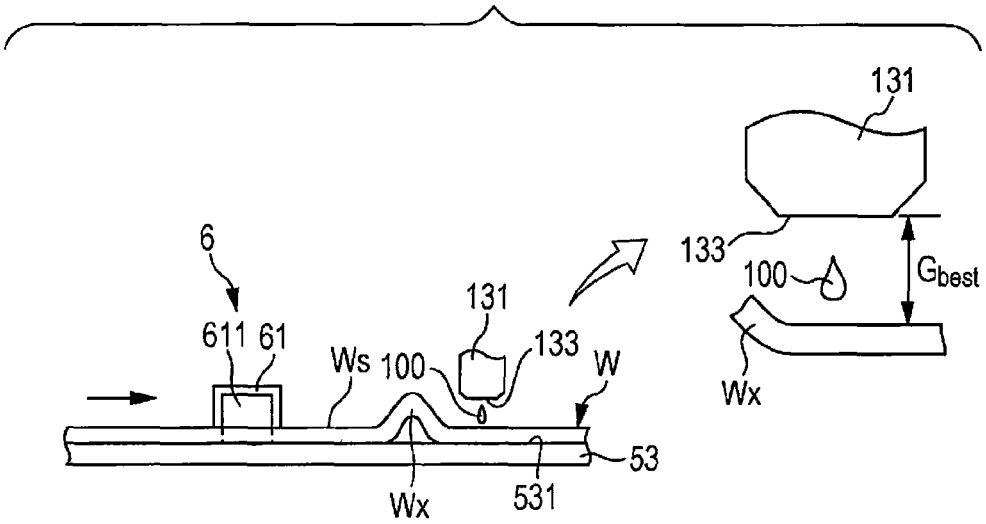
FIG. 16 is a diagram for describing an operation of the printing apparatus which is illustrated in FIG. 1.
Figure 17:
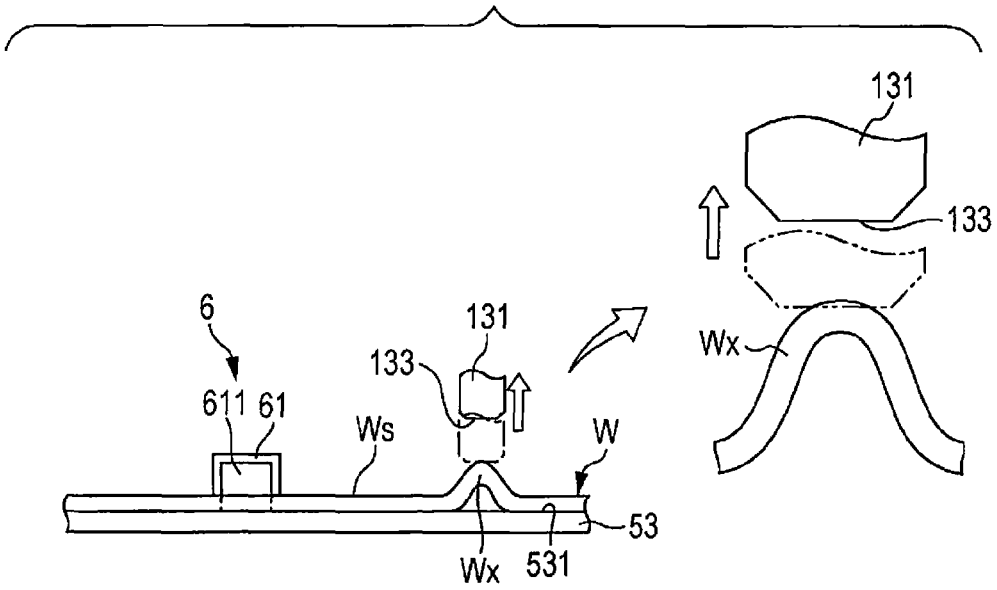
FIG. 17 is a diagram for describing an operation of the printing apparatus which is illustrated in FIG. 1.

As shown in FIG. 16, the wrinkle Wx is further moved to the downstream side and comes close to the ink jet head 131. Presently, the wrinkle Wx appears to come into contact with the ink jet head 131, but as shown in FIG. 17, in the printing apparatus 1, the adjustment section 14 is operated, and the lower surface 133 of the ink jet head 131 is raised to a position which is higher than the upper surface position P of the wrinkle Wx, or the ink jet head 131 is caused to retreat from on the workpiece W due to the movement of the carriage unit 132 in the x axis direction. Thereby, as shown in FIG. 17, it is possible to securely avoid the wrinkle Wx coming into contact with the ink jet head 131.

Furthermore, in the printing apparatus 1, the ink jet head 131 is raised and discharge of the ink 100 stops. Since the wrinkle Wx has a portion which is not able to be used as a product even if printing is executed, it is possible to suppress waste of the ink 100 by avoiding discharge of the ink 100 to the portion.

Figure 18:
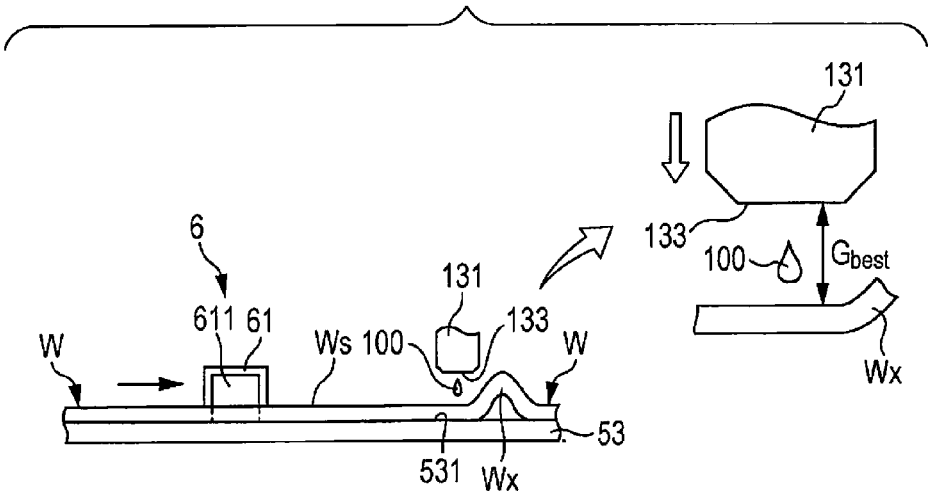
FIG. 18 is a diagram for describing an operation of the printing apparatus which is illustrated in FIG. 1.

As shown in FIG. 18, if the wrinkle Wx moves further to the downstream side than the ink jet head 131, the ink jet head 131 is lowered, and the re-separation distance $G=G_{best}$. Then, at the same time, discharge of the ink 100 is restarted.

In addition, in the same manner as the wrinkle Wx' described above, it is possible to accurately know the timing at which the ink jet head 131 is raised and lowered even in the case of the wrinkle Wx. Thereby, it is possible to minimize a required time for stopping printing by raising the ink jet head 131. Consequently, it is possible to reduce the size of a waste portion where printing is not executed on the workpiece W as much as possible.

In this manner, according to the invention, in a case where the wrinkle Wx' is detected which is lower than the reference position $P_0$, printing is performed even on the wrinkle Wx', and in a case where the wrinkle Wx is higher than the reference position $P_0$, the printing is stopped on the wrinkle Wx. That is, it is possible to select a first mode in which printing is performed, and a second mode in which printing is avoided by adjusting the height of the ink jet head 131 according to the upper surface position P which is detected by the detecting section 6. Thereby, in the manner of the related art, it is possible to omit the work in which the operator gives a command to an apparatus. Consequently, it is possible to securely prevent an error from being generated in the work, and it is possible to substantially reduce the burden on the operator. As a result, it is possible to accurately and simply perform favorable printing.

Here, when the workpiece W is transported in a state in which discharge of the ink 100 is stopped, the transport speed may be faster than the transport speed during normal printing. Thereby, it is possible to shorten the time for which printing is stopped. Consequently, it is possible to increase printing efficiency.

As above, a process which avoids printing on the wrinkle Wx by detecting the wrinkle Wx is stored in advance in the memory section 152 of the control section 15 as a control program. The control program is described based on the flowcharts in FIGS. 21 and 22.

First, prior to starting printing, the operator disposes the workpiece W on the endless belt 53 (refer to FIG. 5). Next, the upper surface position P (thickness t) of the workpiece W is detected (step S101). Then, the separation distance G between the upper surface position P of the workpiece W and the ink jet head 131 is calculated (step S102). The separation distance G is calculated based on the encoder value of the encoder 141 of the adjustment section 14 and the upper surface position P which is obtained in step S101.

In step S103, the threshold $Q_0$ is set. The threshold $Q_0$ is set based on the upper surface position P of the workpiece W which is obtained in step S101 and the separation distance $G_{best}$ which is stored according to the upper surface position P.

Then, in step S104, it is detected whether the separation distance G which is obtained in step S102 is the separation distance $G_{best}$. In step S104, in a case where it is determined that the separation distance $G=G_{best}$, step S106 is performed. In step S104, as shown in FIG. 6, in a case where it is determined that $G\neq G_{best}$, the height of the ink jet head 131 is adjusted by operating the adjustment section 14 (step S105), and the process returns to step S104. Through steps S101 to S105, the separation distance $G=G_{best}$.

Then, printing is started by operating the transport mechanism section 12 and the printing mechanism section 13, and detection of the wrinkle Wx is started by operating the sensor 61 (step S106).

In step S107, it is determined whether the amount of received light Q is reduced. In step S107, in a case where it is determined that the amount of received light Q does not change, in step S113, it is determined whether printing is completed. In step S107, in a case where it is determined that the amount of received light Q is reduced, in step S108, it is determined whether the amount of received light Q is lower than the threshold $Q_0$.

In step S108, in a case where it is determined that the amount of received light Q is not lower than the threshold $Q_0$, a timer is operated (step S109), and it is determined whether or not the time is up (step S110). In step S110, if the time is not up, it is determined that there is noise and the process returns to step S107, and the subsequent steps are executed in order.

In step S110, if the time is up, as shown in FIG. 9, it is determined that the wrinkle Wx' is generated. At this time, the distance $L_2$ is calculated from the front end Wxf' of the wrinkle Wx' in the manner described above to the ink jet head 131 (step S111).

Then, as shown in FIG. 10, a state in which the transport mechanism section 12 is operated is continued, and as shown in FIG. 11, if moved by the distance $L_2$, the height of the ink jet head 131 is adjusted by operating the adjustment section 14 (step S112). At this time, since it is possible to detect the raised portion height H of the wrinkle Wx' from the upper surface position P of the wrinkle Wx', the ink jet head 131 is raised by the raised portion height H. Thereby, it is possible to maintain the separation distance $G=G_{best}$.

Then, as described above, since the length from the front end Wxf' of the wrinkle Wx' to the back end Wxb' is calculated, the ink jet head 131 is lowered as soon as the wrinkle Wx' has passed through the ink jet head 131. Thereby, even when the ink jet head 131 is lowered, it is possible to maintain the separation distance $G=G_{best}$.

Then, in step S113, it is determined whether printing is completed. In a case where it is determined that printing is not yet completed, the process returns to step S107.

Here, in step S108, in a case where it is determined that the amount of received light Q is lower than the threshold $Q_0$, the timer is operated (step S114), and it is determined whether the time is up (step S115). If the time is up, it is considered that the wrinkle Wx is generated (refer to FIGS. 14 and 15).

Then, in the same manner as step S111, the distance from the front end Wxf of the wrinkle Wx to the ink jet head 131 is calculated (step S116).

As shown in FIG. 16, the state in which the transport mechanism section 12 is operated is continued, and if the transport mechanism section 12 comes close to the ink jet head 131, discharge of the ink 100 is stopped (step S117). Then, as shown in FIG. 17, the height of the ink jet head 131 is adjusted by operating the adjustment section 14 (step S118).

At this time, the ink jet head 131 is raised to a height at which the wrinkle Wx does not come into contact with the ink jet head 131. Then, as shown in FIG. 18, if the wrinkle Wx passes directly below the ink jet head 131, the ink jet head 131 is lowered directly below, and discharge of the ink 100 is restarted (step S119).

Then, in step S113, in a case where it is determined that printing is completed, printing ends by stopping the operation of the transport mechanism section 12, the printing mechanism section 13, and the detecting section 6.

As described above, in the printing apparatus 1, it is possible to select the first mode in which printing is performed, and the second mode in which printing is avoided by adjusting the height of the ink jet head 131 according to the upper surface position P of the workpiece W which is detected by the detecting section 6. Thereby, unlike the related art, it is possible to omit the work in which the operator selects each mode. Consequently, it is possible to securely prevent an error from being generated in the work in which each mode is selected, and it is possible to substantially reduce the burden on the operator. As a result, it is possible to accurately and simply perform favorable printing.

Second Embodiment

FIGS. 23A to 23G are enlarged side surface diagrams illustrating the printing apparatus of the invention (second embodiment).

The second embodiment of the printing apparatus of the invention will be described below with reference to the drawings, but will be described focusing on differences from the embodiment described above, and the same matter is omitted from the description.

The present embodiment is the same as the first embodiment aside from the control program being different.

As shown in FIGS. 23A to 23G, in the printing apparatus 1, it is easy to understand the distance by which the wrinkle Wx is transported from when the wrinkle Wx is detected for the ink jet head 131 to be raised. This will be described below.

Figures 23A, 23B, 23C, 23D, 23E, 23F, 23G:
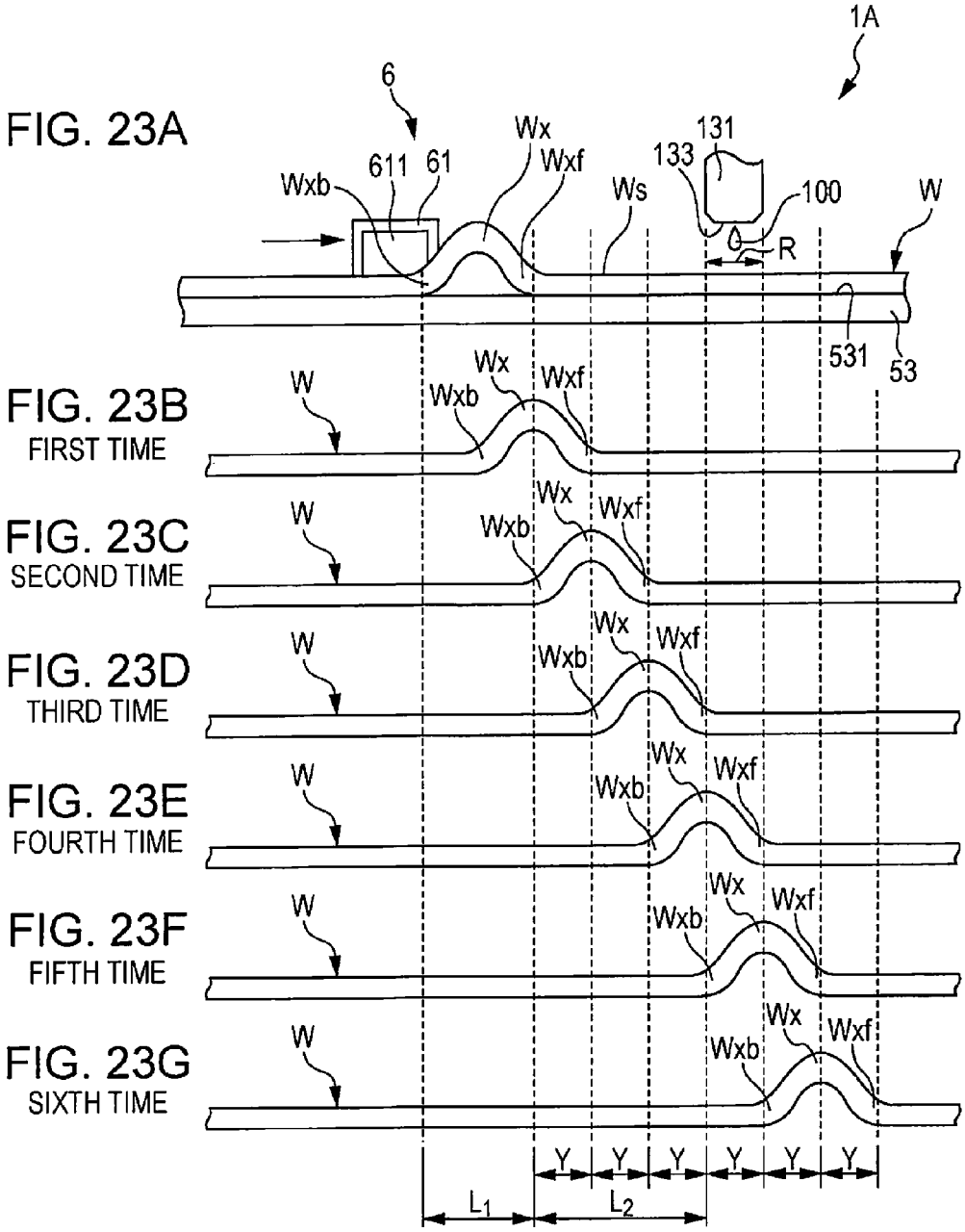
FIGS. 23A to 23G are enlarged side surface diagrams illustrating a printing apparatus of the invention (second embodiment).

FIG. 23A is a diagram illustrating a printing apparatus 1A when the wrinkle Wx is considered to be generated. The distance $L_2$ from the front end Wxf of the wrinkle Wx to the ink jet head 131 when the wrinkle Wx is considered to be generated is able to be obtained in the same manner as in the first embodiment.

Here, in the printing apparatus 1A, the transport mechanism section 12 intermittently feeds the workpiece W, and an amount of transport Y in one intermittent feeding period is the previous value. Here, in the printing apparatus 1A, an integer n (decimal point is truncated) is calculated by dividing the distance $L_2$ by the amount of transport Y in one intermittent feeding period.

If subsequent intermittent feeding is performed n times, the obtained integer n is a numerical value which illustrates whether the front end Wxf of the wrinkle Wx is positioned directly in front of a printing region R of the ink jet head 131.

Here, in the state which is shown in FIG. 23A, when the calculation is performed, a numerical value is obtained where n=3. For this reason, from the state shown in FIG. 23A, when as shown in FIG. 23B, the first intermittent feeding is performed, as shown in FIG. 23C, the second intermittent feeding is performed, and as shown in FIG. 23D, the third intermittent feeding is performed, the wrinkle Wx is positioned directly in front of the ink jet head 131.

Then, when the fourth intermittent feeding which is illustrated in FIG. 23E is performed, the ink jet head 131 is raised.

In addition, since the length $L_1$ of the wrinkle Wx is understood, now, an integer n' (decimal point is rounded up) is obtained by dividing the length $L_1$ by the amount of transport Y in one intermittent feeding period. The obtained n' is a numerical value which indicates whether the back end Wxb of the wrinkle Wx comes away from the printing region R when subsequent intermittent feeding is performed a number of times. Here, in the embodiment n'=2.

When, as shown in FIG. 23F, intermittent feeding is performed one more time (five times in total), and as shown in FIG. 23G, intermittent feeding is performed one more time (six times in total), the back end Wxb of the wrinkle Wx comes away from the printing region R. When the sixth intermittent feeding, which is shown in FIG. 23G, is performed, the ink jet head 131 is lowered.

In this manner, it is possible to accurately know the timing at which the ink jet head 131 is raised and lowered based on the amount of transport Y in one intermittent feeding period. Thereby, in the same manner as the first embodiment, it is possible to securely avoid the wrinkle Wx coming into contact with the ink jet head 131. In addition, it is possible to also execute printing immediately before and immediately after the wrinkle Wx. Consequently, it is possible to reduce the size of the portion on which printing is not executed before and after the wrinkle Wx as much as possible. As a result, it is possible to reduce the size of portion in which the workpiece W is wasted as much as possible.

Third Embodiment

Figure 24:
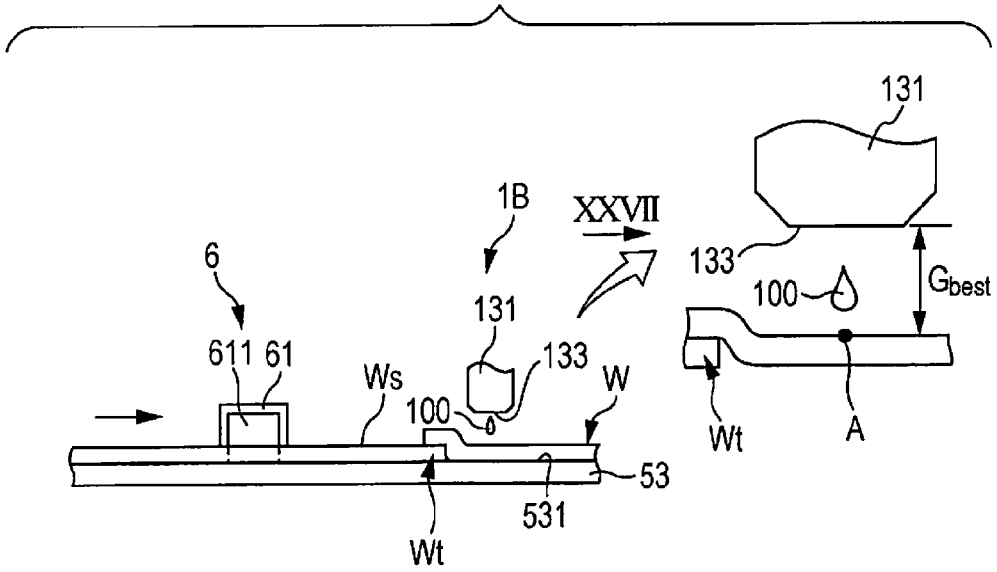
FIG. 24 is a diagram illustrating an operation of a printing apparatus of the invention (third embodiment).
Figure 25:
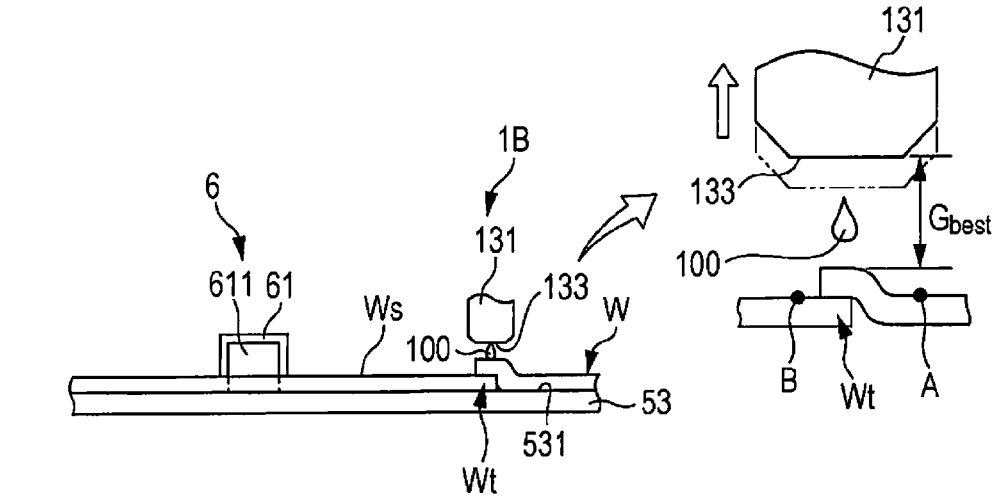
FIG. 25 is a diagram illustrating an operation of the printing apparatus of the invention (third embodiment).
Figure 26:
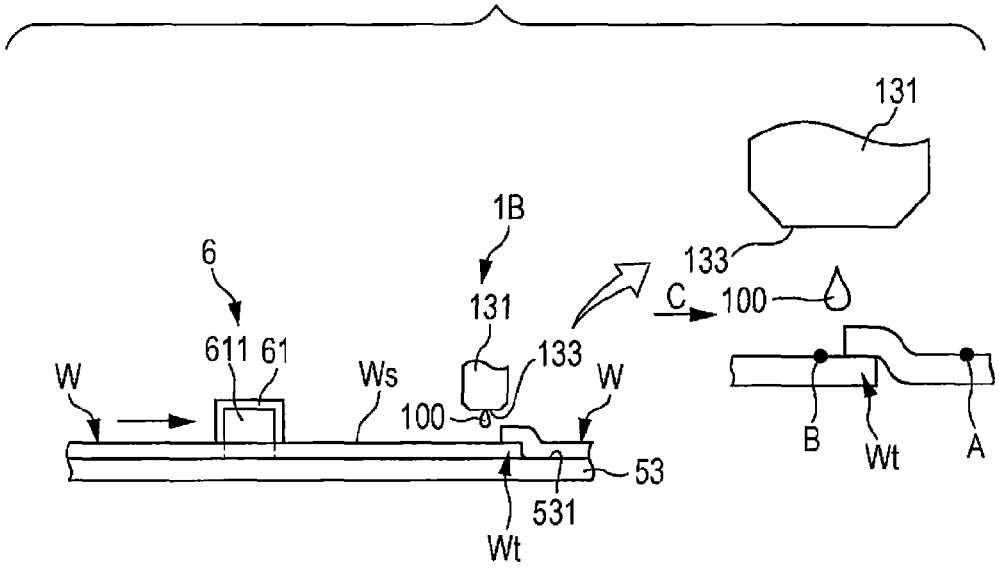
FIG. 26 is a diagram illustrating an operation of the printing apparatus of the invention (third embodiment).
Figure 27:
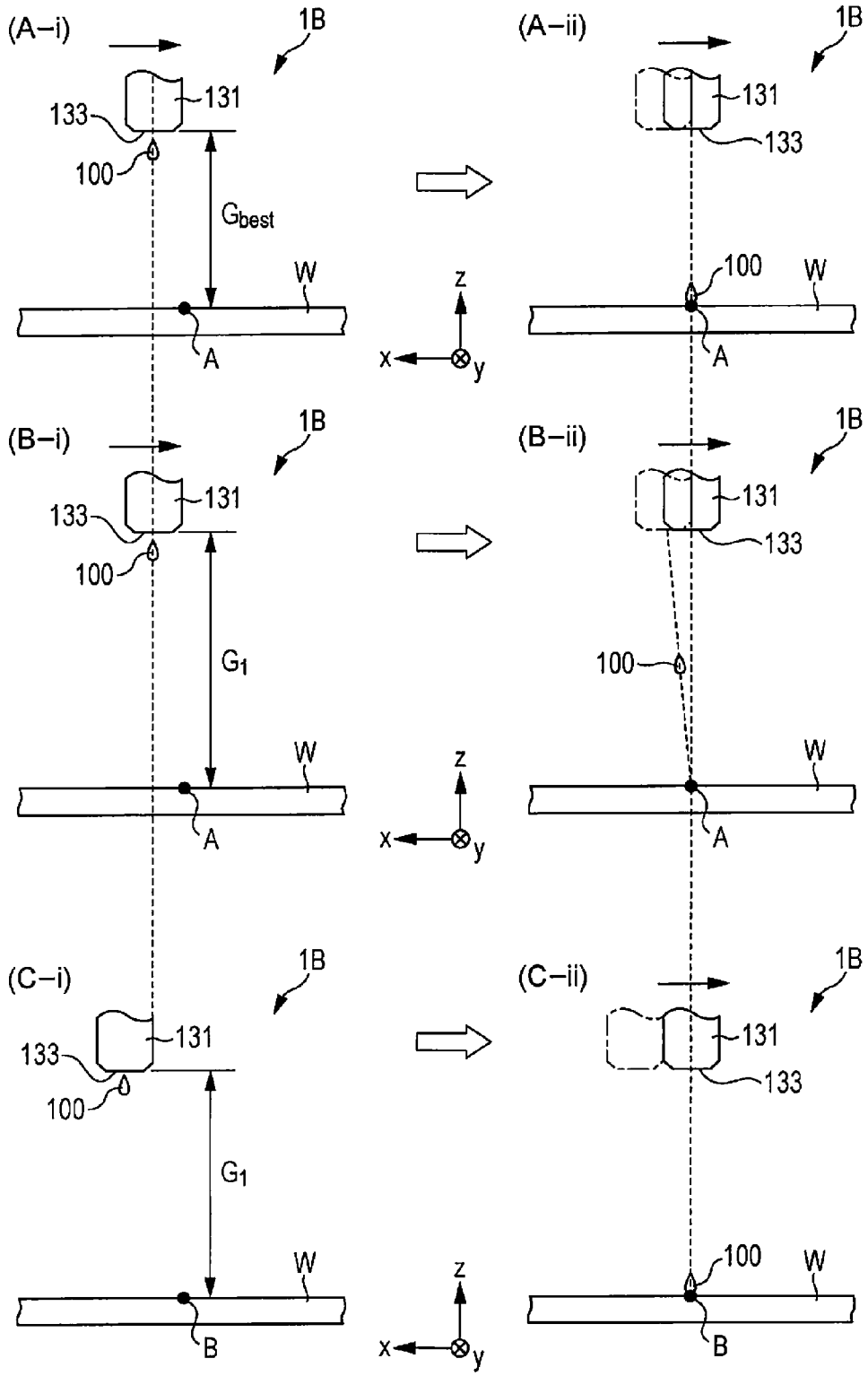
FIG. 27 is a diagram illustrating the printing apparatus of the invention (third embodiment) viewed from the upstream side.

FIGS. 24 to 26 are diagrams illustrating operations of the printing apparatus of the invention (third embodiment). FIG. 27 is a diagram illustrating the printing apparatus of the invention (third embodiment) viewed from the upstream side.

The third embodiment of the printing apparatus of the invention will be described below with reference to the drawings, but will be described focusing on differences from the embodiments described above, and the same matter is omitted from the description.

The present embodiment is the same as the first embodiment aside from the control program being different.

As shown in FIG. 24, in the present embodiment, a printing apparatus 1B adjusts the timing at which the ink 100 is discharged according to the extent of the separation distance G. This will be described below. Here, in the embodiment, the "raised portion" is described as a join Wt.

FIG. 24, is a diagram in which the join Wt comes close to the ink jet head 131 by moving from the upstream side. From this state, when the join Wt is transported further to the downstream side and passes directly below the ink jet head 131, as shown in FIG. 25, the ink jet head 131 is raised while the ink 100 is discharged. As shown in FIG. 26, when the join Wt is moved further to the downstream side than the ink jet head 131, the separation distance G becomes a separation distance $G_1$ which is larger than the separation distance $G_{best}$.

Here, (A-i) and (A-ii) in FIG. 27 are diagrams which are viewed from an arrow XXVII direction in FIG. 24.

As shown in (A-i) in FIG. 27, in a case where it is desired to land the ink 100 on a point A while moving to the −x axis side, the ink jet head 131 discharges the ink 100 on the front side of the point A, that is, further on the +x axis side than the point A. Thereby, the ink 100 lands on the point A (refer to (A-ii) in FIG. 27) when the ink jet head 131 comes directly above the point A.

Meanwhile, as shown in (B-i) in FIG. 27, in a case where the separation distance $G=G_1$, the ink 100 is discharged at the same timing as when the separation distance is $G_{best}$ which is shown in (A-i) in FIG. 27, that is, when the position is the same in the x axis direction. At this time, in (B-i) and (B-ii) in FIG. 27, the flight time of the ink is lengthened by the amount that the separation distance $G_1$ is larger than the separation distance $G_{best}$. For this reason, a phenomenon occurs in which the ink 100 does not yet land on the point A (refer to (B-ii) in FIG. 27) when the ink jet head 131 moves directly above the point A. In addition, in (B-ii) in FIG. 27, the position at which the ink 100 lands is slightly shifted from the point A to the −x axis side.

As described above, due to the size of the separation distance G, the landing positions of the ink 100 are deviated even if the discharge timing of the ink 100 is the same, but it is possible to eliminate this in the printing apparatus 1B.

Here, (C-i) and (C-ii) in FIG. 27 are diagrams which are viewed from an arrow XXVII direction in FIG. 26.

As shown in (C-i) in FIG. 27, in the printing apparatus 1B, in a case where ink is landed at a point B which is at the same position as the point A in the y axis direction when the separation distance $G=G_1$, the ink 100 is discharged further on the +x axis side than the position which is illustrated in (A-i) in FIG. 27. That is, the discharge timing of the ink 100 is slightly sped up. Thereby, the ink 100 lands on the point B regardless of whether the flight time is longer than in the case of the separation distance $G_{best}$.

In this manner, in the embodiment, it is possible for the ink 100 to be securely landed at a target position by shifting the discharge timing of the ink 100 according to the extent of the separation distance G. Thereby, even if the separation distance G is changed, it is possible to prevent a reduction of printing quality, and it is possible to perform favorable printing.

Fourth Embodiment

Figure 28:
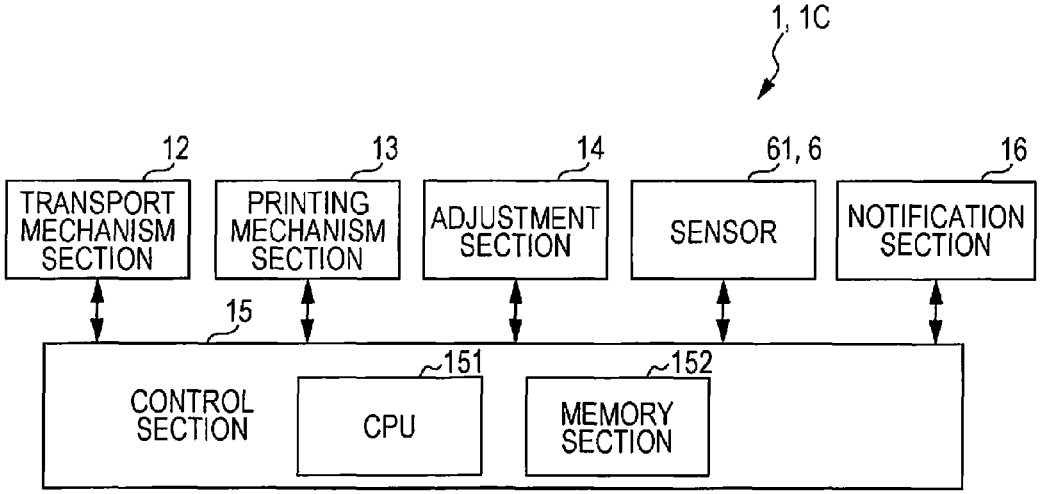
FIG. 28 is a block diagram illustrating a configuration of a printing apparatus of the invention (fourth embodiment).
Figure 29:
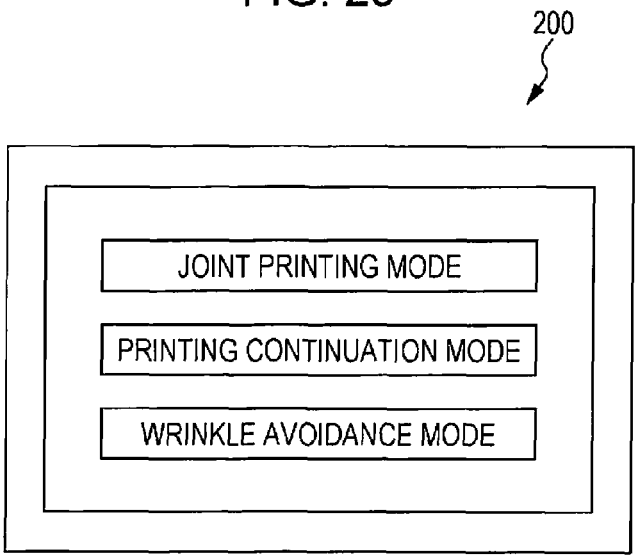
Figure 30:
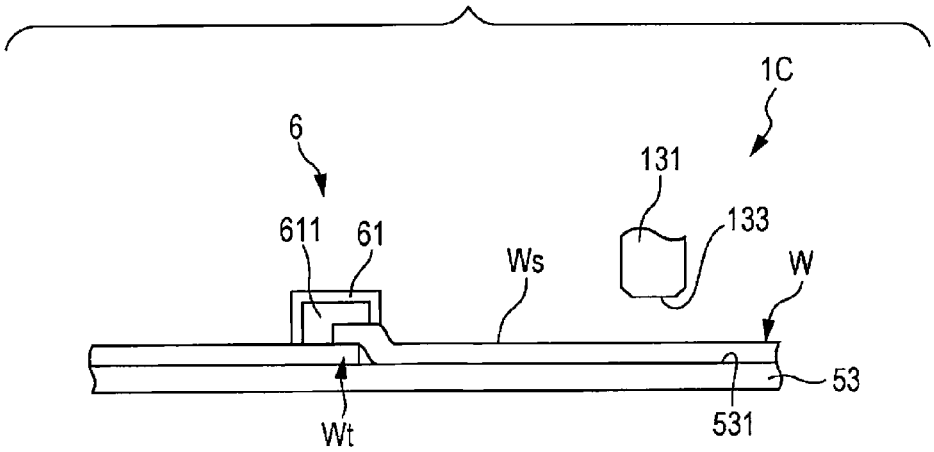
FIG. 30 is a diagram illustrating an operation of the printing apparatus which is illustrated in FIG. 28.
Figure 31:
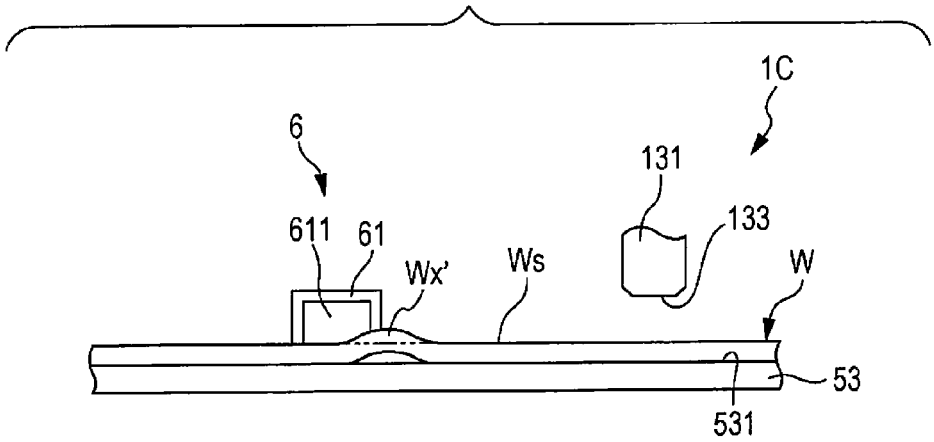
FIG. 31 is a diagram illustrating an operation of the printing apparatus which is illustrated in FIG. 28.
Figure 32:
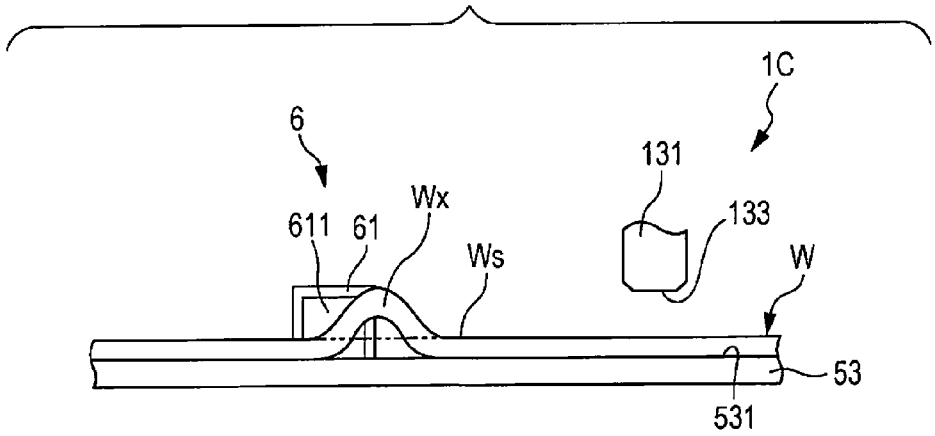
FIG. 32 is a diagram illustrating an operation of the printing apparatus which is illustrated in FIG. 28.

FIG. 28 is a block diagram illustrating a configuration of a printing apparatus of the invention (fourth embodiment). FIG. 29 is a diagram illustrating a touch panel which the printing apparatus that is illustrated in FIG. 28 is provided with. FIGS. 30 to 32 are diagrams illustrating operations of the printing apparatus which is illustrated in FIG. 28.

The fourth embodiment of the printing apparatus of the invention will be described below with reference to the drawings, but will be described focusing on differences from the embodiments described above, and the same matter is omitted from the description.

The present embodiment is the same as the first embodiment aside from the control program being different.

As shown in FIG. 28, a printing apparatus 1C further has a notification section 16 which notifies regarding the detection of the raised portion. The notification section 16 is not particularly limited, but for example, a voice notification section, a light emission notification section, a screen display notification section, and the like are given as examples.

In addition, in the printing apparatus 1, if the detecting section 6 detects the raised portion, the notification section 16 is operated, and the operation of each of the transport mechanism section 12 and the printing mechanism section 13 is stopped. Then, the operator performs the work as below.

First, in the printing apparatus 1C in the printing stopped state, it is visually confirmed whether the raised portion is the wrinkle Wx or the join Wt. Then, using the touch panel 200 which is illustrated in FIG. 29, any one of the three modes of "join printing mode", "printing continuation mode", and "wrinkle avoidance mode" is selected.

Join Printing Mode

As shown in FIG. 30, in a case where the operator determines that the raised portion is the join Wt, since there is no abnormality, the operator selects the "join printing mode" using the touch panel. At this time, in the same manner as in the "first mode" in the first embodiment, when the join Wt passes directly below the ink jet head 131, the ink jet head 131 is raised according to the upper surface position P of the join Wt while the ink 100 is discharged. Then, if the join Wt moves further to the downstream side than the ink jet head 131, the ink jet head 131 is lowered.

Printing Continuation Mode

As shown in FIG. 31, in a case where the raised portion is the wrinkle Wx', the operator straightens out the peripheral portion of the wrinkle Wx'. Then, as shown by the chain double-dashed line in FIG. 31, if it is possible to eliminate the wrinkle Wx', the "printing continuation mode" is selected to continue normal printing. In this case, normal printing is restarted.

Wrinkle Avoidance Mode

As shown in FIG. 32, in the same manner as above, the raised portion is the wrinkle Wx, and when the wrinkle Wx is straightened out, in a case where it is determined that it is difficult to eliminate the wrinkle, the wrinkle avoidance mode is selected. At this time, in the same manner as in the second mode in the first embodiment, when the wrinkle Wx passes directly below the ink jet head 131, the ink jet head 131 is raised to a position which does not come into contact with the wrinkle Wx while the discharge of the ink 100 is stopped. Then, if the wrinkle Wx moves further to the downstream side than the ink jet head 131, the ink jet head 131 is lowered and discharge of the ink 100 is restarted.

Here, when the workpiece W is transported in a state in which discharge of the ink Q is stopped, in the same manner as in the first embodiment, the transport speed may be faster than the transport speed during normal printing.

In such a printing apparatus 1C, in the same manner as in the first embodiment, it is possible to securely prevent the raised portion from coming into contact with the ink jet head 131. Furthermore, since it is possible to eliminate the wrinkle Wx' according to the extent thereof, it is possible to increase the size of a portion in which it is possible to favorably perform printing on the workpiece W as much as possible.

The embodiments of the invention are described above as illustrative embodiments, but the invention is not limited thereto, and it is possible for each section which configures the printing apparatus to be substituted with an arbitrary configuration which exhibits the same function. In addition, an arbitrary component may be added.

In addition, the printing apparatus of the invention may be a combination of two or more arbitrary configurations (characteristics) among each of the embodiments.

Here, in each embodiment, one sensor is provided, but the invention is not limited thereto, and there may be two or more.

In addition, in each of the embodiments, the detection surface has a square shape, but the invention is not limited thereto, and may be formed in any of a circular shape, an elliptical shape, a triangular shape, a polygonal shape, or the like.

In addition, in each of the embodiments, the adjustment of the separation distance of the upper surface of the recording medium and the nozzle is performed by raising or lowering the nozzle, but the invention is not limited thereto, and the adjustment may be performed by raising or lowering the endless belt.

In addition, in each of the embodiments, in the "second mode", the height of the nozzle is adjusted by the adjustment section, but the invention is not limited thereto, and the nozzle may move in an escaping manner in the width direction of the recording medium.

In addition, in each of the embodiments, the height of the nozzle is adjusted, but the invention is not limited thereto, and as long as the height is to an extent that the raised portion does not come into contact with the nozzle, the height of the nozzle need not be adjusted.

The entire disclosure of Japanese Patent Application No. 2014-230436, filed Nov. 13, 2014 is expressly incorporated by reference herein.

What is claimed is:

1. A printing apparatus comprising:

a transport section which has a support surface that supports a recording medium with a sheet form, and supports and transports the recording medium on the support surface;

a printing section which is disposed facing the support surface via a gap, and has a nozzle that executes printing on the recording medium which is transported by the transport section;

a detecting section which is arranged further on the upstream side in the transport direction of the recording medium than the nozzle, and detects an upper surface position of the recording medium;

an adjustment section which adjusts a separation distance between the support surface and the nozzle; and a control section which controls the operation of the transport section, the printing section, the detecting section, and the adjustment section, and the control section comparing the upper surface position, which the detection section has detected, with a reference position, in response to the comparing, the control section selecting one of a first mode and a second mode, the first mode being a mode in which the control section controls the adjustment section to increase the separation distance and controls the nozzle to execute the printing on the recording medium and which is selected when the upper surface position is lower than the reference position, the second mode being a mode in which the control section controls the nozzle to stop executing of the printing on the recording medium.

2. The printing apparatus according to claim 1, wherein in response to the detecting section detecting a raised portion where the upper surface position is raised, the control section selects the first mode in response to determining that a height of the raised portion is less than a predetermined threshold that corresponds to a value indicates the reference position, and selects the second mode in response to determining that the height of the raised portion is equal to the predetermined threshold or more than the predetermined threshold.

3. The printing apparatus according to claim 2, wherein the adjustment section adjusts the height of the nozzle, and in the first mode, the separation distance is adjusted by raising the nozzle position according to the height of the raised portion when the raised portion passes below the nozzle.

4. The printing apparatus according to claim 2, wherein in the second mode, the stopping of the executing of the printing is maintained until the raised portion is moved further to the downstream side in the transport direction of the recording medium than the nozzle.

5. The printing apparatus according to claim 4, wherein in the second mode, in a case where the height of the raised portion is higher than the position of the nozzle when the printing is stopped, the height of the nozzle is increased above the upper surface position of the raised portion.

6. The printing apparatus according to claim 4, wherein in the second mode, when the executing of the printing is stopped, the transport section increases a transport speed at which the recording medium is transported to be greater than a transport speed of the recording medium during the printing.

7. The printing apparatus according to claim 2, wherein the transport section has a motor and an encoder which detects an amount of rotation of the motor, and the control section detects the timing at which the adjustment section is operated based on the amount of rotation of the motor that is detected by the encoder.

8. The printing apparatus according to claim 2, wherein the transport section transports the recording medium intermittently, and the control section detects the timing at which the adjustment section is operated based on an amount of transport of the recording medium in one time.

9. The printing apparatus according to claim 1, wherein printing is performed by discharging ink from the nozzle, and in the first mode, the control section adjusts the timing at which the ink is discharged according to the extent of the separation distance.

10. The printing apparatus according to claims 1, wherein the recording medium is belt-shaped and is transported in the longitudinal direction, and the detecting section has a light-receiving surface which receives light in the width direction of the recording medium.

11. The printing apparatus according to claim 1, wherein the reference position is set further from the support surface than a position of an upper surface of the recording medium that indicates a distance of the upper surface from an opposite surface of the recording medium, which is opposite the upper surface and contacts the support surface.

12. The printing apparatus according to claim 1, wherein in response to determining that the upper surface position that the detection section has detected is the same as the reference position or closer to the support surface than the reference position, the control section selects the first mode, and in response to determining that the upper surface position that the detection section has detected is further from the support surface than the reference position, the control section selects the second mode.

13. A printing apparatus comprising:

a transport section which has a support surface that supports a recording medium with a sheet form, and supports and transports the recording medium on the support surface;

a printing section which is disposed facing the support surface via a gap, and has a nozzle that executes printing by discharging ink on the recording medium which is transported by the transport section;

a detecting section which is provided further on the upstream side in the transport direction of the recording medium than the nozzle, and detects an upper surface position of the recording medium;

a notification section which notifies regarding a detection result of the detecting section;

a display that displays at least a first mode and a second mode, the first mode being a mode in which the control section controls the nozzle to continue to execute the printing, the second mode being a mode in which the control section controls the nozzle to avoid executing the printing; and a control section which controls the operation of the transport section, the printing section, the detecting section, the notification section, and the display, in response to the detecting section detecting the upper surface position of the recording medium, the notification section notifying, and the control section controlling the transport section and the printing section to stop operation of the transport section and the printing section until the control section accepts selection from the first mode and the second mode, in response to the control section accepting the selection, the control section controlling the transport section and the printing section based on the selection.

* * * * *